US007624682B2

(12) United States Patent
Lloyd

(10) Patent No.: US 7,624,682 B2
(45) Date of Patent: Dec. 1, 2009

(54) KINETIC ENERGY ROD WARHEAD WITH LOWER DEPLOYMENT ANGLES

(75) Inventor: Richard M. Lloyd, Melrose, MA (US)

(73) Assignee: Raytheon Company, Waltman, MA (US)

( * ) Notice: Subject to any disclaimer, the term of this patent is extended or adjusted under 35 U.S.C. 154(b) by 415 days.

(21) Appl. No.: 11/060,179

(22) Filed: Feb. 17, 2005

(65) Prior Publication Data

US 2006/0086279 A1 Apr. 27, 2006

Related U.S. Application Data

(63) Continuation-in-part of application No. 10/938,355, filed on Sep. 10, 2004, now abandoned, and a continuation-in-part of application No. 10/924,104, filed on Aug. 23, 2004, now abandoned, which is a continuation-in-part of application No. 10/456,777, filed on Jun. 6, 2003, now Pat. No. 6,910,423, which is a continuation-in-part of application No. 09/938,022, filed on Aug. 23, 2001, now Pat. No. 6,598,534.

(51) Int. Cl.
*F42B 12/32* (2006.01)

(52) U.S. Cl. ..... 102/497

(58) Field of Classification Search ..... 102/494–497, 102/489

See application file for complete search history.

(56) References Cited

U.S. PATENT DOCUMENTS

| | | | |
|---|---|---|---|
| 1,198,035 | A | 9/1916 | Huntington |
| 1,229,421 | A | 6/1917 | Downs |
| 1,235,076 | A | 7/1917 | Stanton |
| 1,244,046 | A | 10/1917 | Ffrench |
| 1,300,333 | A | 4/1919 | Berry |
| 1,305,967 | A | 6/1919 | Hawks |
| 2,296,980 | A | 9/1942 | Carmichael |
| 2,308,683 | A | 1/1943 | Forbes |
| 2,322,624 | A | 6/1943 | Forbes |
| 2,337,765 | A | 12/1943 | Nahirney |
| 2,925,965 | A | 2/1960 | Pierce |
| 2,988,994 | A | 6/1961 | Fleischer, Jr. et al. |
| 3,332,348 | A | 7/1967 | Myers et al. |
| 3,464,356 | A | 9/1969 | Wasserman et al. |
| 3,565,009 | A | 2/1971 | Allred et al. |

(Continued)

FOREIGN PATENT DOCUMENTS

DE 3327043 A1 2/1985

(Continued)

OTHER PUBLICATIONS

Richard M. Lloyd, "Physics of Direct Hit and Near Miss Warhead Technology", vol. 194, Progress in Astronautics and Aeronautics, Copyright 2001 by the American Institute of Aeronautics and Astronautics, Inc., Chapter 3, pp. 99-197.

(Continued)

*Primary Examiner*—Troy Chambers
(74) *Attorney, Agent, or Firm*—Iandiorio Teska & Coleman

(57) ABSTRACT

A kinetic energy rod warhead includes a projectile core which includes a plurality of individual projectiles, an explosive charge about the core, at least one detonator for the explosive charge, and an explosive sheet on each end of the projectile core.

5 Claims, 41 Drawing Sheets

U.S. PATENT DOCUMENTS

| | | | | | |
|---|---|---|---|---|---|
| 3,656,433 | A | | 4/1972 | Thrailkill et al. | |
| 3,665,009 | A | | 5/1972 | Dickinson, Jr. | |
| 3,757,694 | A | | 9/1973 | Talley et al. | |
| 3,771,455 | A | | 11/1973 | Haas | |
| 3,796,159 | A | | 3/1974 | Conger | |
| 3,797,359 | A | | 3/1974 | Mawhinney etal. | |
| 3,818,833 | A | | 6/1974 | Throner, Jr. | |
| 3,846,878 | A | | 11/1974 | Monson et al. | |
| 3,851,590 | A | | 12/1974 | LaCosta | |
| 3,861,314 | A | | 1/1975 | Barr | |
| 3,877,376 | A | | 4/1975 | Kupelian | |
| 3,902,424 | A | | 9/1975 | Dietsch et al. | |
| 3,903,804 | A | | 9/1975 | Luttrell et al. | |
| 3,915,092 | A | | 10/1975 | Monson et al. | |
| 3,941,059 | A | | 3/1976 | Cobb | |
| 3,949,674 | A | | 4/1976 | Talley | |
| 3,954,060 | A | | 5/1976 | Haag et al. | |
| 3,960,085 | A | * | 6/1976 | Abernathy et al. | 102/492 |
| 3,977,330 | A | | 8/1976 | Held | |
| 4,015,527 | A | | 4/1977 | Evans | |
| 4,026,213 | A | * | 5/1977 | Kempton | 102/475 |
| 4,036,140 | A | | 7/1977 | Korr et al. | |
| 4,089,267 | A | | 5/1978 | Mescall et al. | |
| 4,106,410 | A | * | 8/1978 | Borcher et al. | 102/495 |
| 4,106,411 | A | * | 8/1978 | Borcher et al. | 102/495 |
| 4,147,108 | A | * | 4/1979 | Gore et al. | 102/494 |
| 4,172,407 | A | | 10/1979 | Wentink | |
| 4,210,082 | A | | 7/1980 | Brothers | |
| 4,211,169 | A | | 7/1980 | Brothers | |
| 4,231,293 | A | | 11/1980 | Dahn et al. | |
| 4,289,073 | A | | 9/1981 | Romer et al. | |
| 4,353,305 | A | | 10/1982 | Moreau et al. | |
| 4,376,901 | A | | 3/1983 | Pettibone et al. | |
| 4,430,941 | A | | 2/1984 | Raech, Jr. et al. | |
| 4,455,943 | A | | 6/1984 | Pinson | |
| 4,516,501 | A | | 5/1985 | Held et al. | |
| 4,538,519 | A | | 9/1985 | Witt et al. | |
| 4,638,737 | A | | 1/1987 | McIngvale | |
| 4,655,139 | A | | 4/1987 | Wilhelm | |
| 4,658,727 | A | | 4/1987 | Wilhelm et al. | |
| 4,676,167 | A | | 6/1987 | Huber, Jr. et al. | |
| 4,729,321 | A | | 3/1988 | Stafford | |
| 4,745,864 | A | | 5/1988 | Craddock | |
| 4,770,101 | A | | 9/1988 | Robertson et al. | |
| 4,777,882 | A | | 10/1988 | Dieval | |
| 4,848,239 | A | | 7/1989 | Wilhelm | |
| 4,872,409 | A | | 10/1989 | Becker et al. | |
| 4,922,826 | A | | 5/1990 | Busch et al. | |
| 4,957,046 | A | | 9/1990 | Puttock | |
| 4,995,573 | A | | 2/1991 | Wallow | |
| 4,996,923 | A | | 3/1991 | Theising | |
| H1047 | H | | 5/1992 | Henderson et al. | |
| H1048 | H | | 5/1992 | Wilson et al. | |
| 5,182,418 | A | | 1/1993 | Talley | |
| 5,223,667 | A | | 6/1993 | Anderson | |
| 5,229,542 | A | | 7/1993 | Bryan et al. | |
| 5,313,890 | A | | 5/1994 | Cuadros | |
| 5,370,053 | A | | 12/1994 | Williams et al. | |
| 5,524,524 | A | | 6/1996 | Richards et al. | |
| 5,535,679 | A | | 7/1996 | Craddock | |
| 5,542,354 | A | | 8/1996 | Sigler | |
| 5,544,589 | A | | 8/1996 | Held | |
| 5,577,431 | A | | 11/1996 | Küsters | |
| 5,578,783 | A | | 11/1996 | Brandeis | |
| 5,583,311 | A | | 12/1996 | Rieger | |
| 5,622,335 | A | | 4/1997 | Trouillot et al. | |
| D380,784 | S | | 7/1997 | Smith | |
| 5,670,735 | A | | 9/1997 | Ortmann et al. | |
| 5,691,502 | A | | 11/1997 | Craddock et al. | |
| 5,796,031 | A | | 8/1998 | Sigler | |
| 5,823,469 | A | | 10/1998 | Arkhangelsky et al. | |
| 5,929,370 | A | | 7/1999 | Brown et al. | |
| 5,936,191 | A | | 8/1999 | Bisping et al. | |
| 6,010,580 | A | | 1/2000 | Dandliker et al. | |
| 6,035,501 | A | | 3/2000 | Bisping et al. | |
| 6,044,765 | A | | 4/2000 | Regebro | |
| 6,186,070 | B1 | | 2/2001 | Fong et al. | |
| 6,223,658 | B1 | | 5/2001 | Rosa et al. | |
| 6,276,277 | B1 | | 8/2001 | Schmacker | |
| 6,279,478 | B1 | | 8/2001 | Ringer et al. | |
| 6,279,482 | B1 | | 8/2001 | Smith et al. | |
| 6,598,534 | B2 | | 7/2003 | Lloyd et al. | |
| 6,622,632 | B1 | | 9/2003 | Spivak | |
| 6,666,145 | B1 | | 12/2003 | Nardone et al. | |
| 2003/0019386 | A1 | | 1/2003 | Lloyd et al. | |
| 2003/0029347 | A1 | | 2/2003 | Lloyd | |
| 2004/0011238 | A1 | | 1/2004 | Ronn et al. | |
| 2004/0055498 | A1 | | 3/2004 | Lloyd | |
| 2004/0055500 | A1 | | 3/2004 | Lloyd | |
| 2004/0129162 | A1 | | 7/2004 | Lloyd | |
| 2004/0200380 | A1 | | 10/2004 | Lloyd | |
| 2005/0016372 | A1 | | 1/2005 | Kilvert | |
| 2005/0109234 | A1 | | 5/2005 | Lloyd | |
| 2005/0115450 | A1 | | 6/2005 | Lloyd | |

FOREIGN PATENT DOCUMENTS

| | | | |
|---|---|---|---|
| DE | 3722420 | | 1/1989 |
| DE | 3735426 | | 5/1989 |
| DE | 3830527 | A1 | 3/1990 |
| DE | 3834367 | | 4/1990 |
| DE | 3934042 | A1 | 4/1991 |
| EP | 270 401 | A1 | 6/1988 |
| EP | 872705 | | 10/1998 |
| EP | 902250 | | 3/1999 |
| FR | 2678723 | A1 | 1/1993 |
| FR | 2695467 | | 3/1994 |
| GB | 550001 | | 12/1942 |
| GB | 2236581 | | 4/1991 |
| JP | 1-296100 | | 11/1989 |
| WO | WO 97/27447 | | 7/1997 |
| WO | WO 9930966 | | 6/1999 |

OTHER PUBLICATIONS

Richard M. Lloyd, "Physics of Direct Hit and Near Miss Warhead Technology", vol. 194, Progress in Astronautics and Aeronautics, Copyright 2001 by the American Institute of Aeronautics and Astronautics, Inc., Chapter 6, pp. 311-406.

FAS Military Analysis Network (http://www.fas.org/man/dod-101/sys/land/m546.htm): M546 APERS-T 105-mm, Jan. 21, 1999.

FAS Military Analysis Network (http://www.fas.org/man/dod-101/sys/land/bullets2.htm): Big Bullets for Beginners, Feb. 6, 2000.

Richard M. Lloyd, "Conventional Warhead Systems Physics and Engineering Design", vol. 179, Progress in Astronautics and Aeronautics, Copyright 1998 by the American Institute of Aeronautics and Astronautics, Inc., Chapter 5, pp. 193-251.

Richard M. Lloyd, "Aligned Rod Lethality Enhanced Concept for Kill Vehicles", 10th AIAA/BMDD Technology Conf., Jul. 23-26, Williamsburg, Virginia, 2001, pp. 1-12.

Richard M. Lloyd, "Conventional Warhead Systems Physics and Engineering Design", vol. 179, Progress in Astronautics and Aeronautics, Copyright 1998 by the American Institute of Aeronautics and Astronautics, Inc., Chapter 2, pp. 19-77.

U.S. Appl. No. 10/301,302, filed Nov. 21, 2002, Lloyd.

U.S. Appl. No. 10/301,420, filed Nov. 21, 2002, Lloyd.

U.S. Appl. No. 10/685,242, filed Oct. 14, 2003, Lloyd.

U.S. Appl. No. 10/924,104, filed Aug. 23, 2004, Lloyd.

U.S. Appl. No. 11/059,891, filed Feb. 17, 2005, Lloyd.

U.S. Appl. No. 10/384,804, filed Mar. 10, 2003, Lloyd.

U.S. Appl. No. 10/960,842, filed Oct. 7, 2004, Lloyd.

Richard M. Lloyd. "Aligned Rod Lethality Enhancement Concept for Kill Vehicles," AIAA/BMDD Technology Conf., Jun. 5, Maastricht, Netherlands, 2001:pp. 1-12.

* cited by examiner

KINETIC ENERGY ROD WARHEAD WITH LOWER DEPLOYMENT ANGLES

RELATED APPLICATIONS

This application is a Continuation-in-Part application of prior U.S. patent application Ser. No. 10/924,104 filed Aug. 23, 2004 now abandoned and it is a Continuation-in-Part application of prior U.S. patent application Ser. No. 10/938,355 filed Sep. 10, 2004 now abandoned, and each of the latter are a Continuation-in-Part of prior U.S. patent application Ser. No. 10/456,777, filed Jun. 6, 2003 now U.S. Pat. No. 6,910,423 which is a Continuation-in-Part of prior U.S. patent application Ser. No. 09/938,022 filed Aug. 23, 2001, issued on Jul. 29, 2003 as U.S. Pat. No. 6,598,534 B2.

FIELD OF THE INVENTION

This invention relates to improvements in kinetic energy rod warheads.

BACKGROUND OF THE INVENTION

Destroying missiles, aircraft, re-entry vehicles and other targets falls into three primary classifications: "hit-to-kill" vehicles, blast fragmentation warheads, and kinetic energy rod warheads.

"Hit-to-kill" vehicles are typically launched into a position proximate a re-entry vehicle or other target via a missile such as the Patriot, THAAD or a standard Block IV missile. The kill vehicle is navigable and designed to strike the re-entry vehicle to render it inoperable. Countermeasures, however, can be used to avoid the "hit-to-kill" vehicle. Moreover, biological warfare bomblets and chemical warfare submunition payloads are carried by some threats and one or more of these bomblets or chemical submunition payloads can survive and cause heavy casualties even if the "hit-to-kill" vehicle accurately strikes the target.

Blast fragmentation type warheads are designed to be carried by existing missiles. Blast fragmentation type warheads, unlike "hit-to-kill" vehicles, are not navigable. Instead, when the missile carrier reaches a position close to an enemy missile or other target, a pre-made band of metal on the warhead is detonated and the pieces of metal are accelerated with high velocity and strike the target. The fragments, however, are not always effective at destroying the target and, again, biological bomblets and/or chemical submunition payloads survive and cause heavy casualties.

The textbook by the inventor hereof, R. Lloyd, "Conventional Warhead Systems Physics and Engineering Design," Progress in Astronautics and Aeronautics (AIAA) Book Series, Vol. 179, ISBN 1-56347-255-4, 1998, incorporated herein by this reference, provides additional details concerning "hit-to-kill" vehicles and blast fragmentation type warheads. Chapter 5 of that textbook, proposes a kinetic energy rod warhead.

The two primary advantages of a kinetic energy rod warheads is that 1) it does not rely on precise navigation as is the case with "hit-to-kill" vehicles and 2) it provides better penetration then blast fragmentation type warheads.

To date, however, kinetic energy rod warheads have not been widely accepted nor have they yet been deployed or fully designed. The primary components associated with a theoretical kinetic energy rod warhead is a hull, a projectile core or bay in the hull including a number of individual lengthy cylindrical projectiles, and an explosive charge in the hull about the projectile bay with sympathetic explosive shields. When the explosive charge is detonated, the projectiles are deployed.

The cylindrical shaped projectiles, however, may tend to break and/or tumble in their deployment. Still other projectiles may approach the target at such a high oblique angle that they do not effectively penetrate the target. See "Aligned Rod Lethality Enhanced Concept for Kill Vehicles," R. Lloyd "Aligned Rod Lethality Enhancement Concept For Kill Vehicles" $10^{th}$ AIAA/BMDD TECHNOLOGY CONF., Jul. 23-26, Williamsburg, Va., 2001 incorporated herein by this reference.

SUMMARY OF THE INVENTION

It is therefore an object of this invention to provide an improved kinetic energy rod warhead.

It is a further object of this invention to provide a higher lethality kinetic energy rod warhead.

It is a further object of this invention to provide a kinetic energy rod warhead with structure therein which aligns the projectiles when they are deployed.

It is a further object of this invention to provide such a kinetic energy rod warhead which is capable of selectively directing the projectiles at a target.

It is a further object of this invention to provide such a kinetic energy rod warhead which prevents the projectiles from breaking when they are deployed.

It is a further object of this invention to provide such a kinetic energy rod warhead which prevents the projectiles from tumbling when they are deployed.

It is a further object of this invention to provide such a kinetic energy rod warhead which insures the projectiles approach the target at a better penetration angle.

It is a further object of this invention to provide such a kinetic energy rod warhead which can be deployed as part of a missile or as part of a "hit-to-kill" vehicle.

It is a further object of this invention to provide such a kinetic energy rod warhead with projectile shapes which have a better chance of penetrating a target.

It is a further object of this invention to provide such a kinetic energy rod warhead with projectile shapes which can be packed more densely.

It is a further object of this invention to provide such a kinetic energy rod warhead which has a better chance of destroying all of the bomblets and chemical submunition payloads of a target to thereby better prevent casualties.

It is a further object of this invention to provide such a kinetic energy rod warhead with a frangible skin that encases the warhead components without interfering with the deployment angle of the projectiles.

It is a further object of this invention to provide such a kinetic energy rod warhead which improves lethality against ballistic missiles having submunition or bomblet payloads.

It is a further object of this invention to provide a kinetic energy rod warhead with an increased spray pattern density and lethality.

It is a further object of this invention to provide such a kinetic energy rod warhead with explosive end plate confinement which reduces edge effects without prohibitively increasing the weight of the kinetic energy rod warhead.

The invention results from the realization that a higher lethality kinetic energy rod warhead with a reduced overall deployment angle of the rods can be achieved with explosive endplates which confine the ends of the warhead and reduce edge effects.

This invention features a kinetic energy rod warhead including a projectile core that includes a plurality of individual projectiles, an explosive charge about the core, at least one detonator for the explosive charge, and an explosive sheet on each end of the projectile core to reduce deployment angles of the projectiles. Each explosive sheet may be made of PBXN-109 and each explosive sheet may be adjacent the explosive charge or attached to the explosive charge. The warhead may include a buffer between each explosive sheet and the projectile core, and the buffer may be made of foam. The warhead may include thin aluminum absorbing layers between the buffers and the projectile core, and it may include thin outer plates disposed on outer surfaces of the explosive sheets. The thin outer plates may be made of aluminum. Each explosive sheet may be at least one order of magnitude thinner than a steel end plate, and each explosive sheet may be structured and arranged to contain the ends of the projectile core when deployed to decrease the deployment angle of the individual projectiles.

In one embodiment, the kinetic energy rod warhead may include a frangible skin about the explosive charge, and the skin may include spaced grooves. The spaced grooves may define a grid matrix on a surface of the skin that fractures and breaks when the detonator detonates the explosive charge and the grid matrix may be disposed on an inner and/or an outer surface of the skin. The spaced grooves may be disposed on an inner surface of the skin or the spaced grooves may be disposed on an outer surface of the skin. Also, the spaced grooves may be disposed on an inner surface and an outer surface of the skin. The skin may be made of steel or aluminum, or it may be made of a ductile material, and the skin may be about 0.15 inches thick. The spaced grooves may be V-notch shaped, saw-tooth shaped, rectangular shaped, square shaped, or circular shaped. The skin may include V-notch shaped grooves formed on an inner surface of the skin and rectangular shaped grooves formed on an outer surface of the skin. The skin may include rectangular shaped grooves formed on the inner surface of the skin and a V-notch shaped groove formed on the outer surface. The spaced grooves may create fracture trajectories in the skin which causes the skin to break and fracture into small fragments when the detonator detonates the explosive charge. The V-notch shaped grooves, the saw tooth shaped grooves, the rectangular shaped grooves, the square shaped grooves, or the circular shaped grooves may each create fracture trajectories in the skin which causes the skin to break and fracture into small fragments when the detonator detonates the explosive charge.

In one example, the kinetic energy rod warhead may include a plurality of individual projectiles that includes different size projectiles. The plurality of different size projectiles may include a larger number of small projectiles and a smaller number of large projectiles. The number of smaller projectiles may be chosen to increase lethality against submunition payloads, and the number of larger projectiles may be chosen to increase lethality against bomblet payloads. The number of smaller projectiles may be chosen to increase the spray pattern density of the projectiles, and the number of larger projectiles may be chosen to decrease the spray pattern density of the projectiles. The smaller projectiles may be located proximate an outer region of the core and the larger projectiles may be located proximate the center region of the core. The plurality of different size projectiles may include about seventy percent smaller projectiles and about thirty percent larger projectiles, and the mass of each large projectile may be greater than the mass of each of small projectile. All the projectiles may have a cruciform cross section. The large and small projectiles may be tightly packed in the core with minimal air spacing therebetween. All the projectiles may be made of tungsten. Each of the small projectiles may weigh less than about 50 grams, or in another example, each of the small projectiles may weigh approximately 28 grams. The projectiles may have a hexagon shape or a cylindrical cross section, or the projectiles may have a non-cylindrical cross section. The projectiles may have a star shape cross section and the projectiles may have flat ends, a non-flat nose, or a pointed nose. The projectiles may have a wedge-shape, the projectiles may be cube shaped, or the projectiles may have a three-dimensional tetris shape.

In another embodiment, the kinetic energy rod warhead may include means for further reducing the deployment angles of the projectiles when the detonator detonates the explosive charge, and the means for further reducing the deployment angles may include a buffer between the explosive charge and the core. The buffer may be a poly foam material and the buffer may extend beyond the core. The means for further reducing may include multiple spaced detonators located proximate the buffer. The core may include a plurality of bays of projectiles. Also, the means for reducing may include a buffer disk between each bay and there may be three bays of projectiles. The means for further reducing may further include selected projectiles which extend continuously through all the bays. Selected projectiles may extend continuously through each bay with frangible portions located at the intersection between two adjacent bays. The core may include a binding wrap around the projectiles, and the projectile core may include an encapsulant sealing the projectiles together. The encapsulant may be glass or grease. The encapsulant may include grease on each projectile and glass in the spaces between projectiles.

In another example, the kinetic energy rod warhead may include the explosive charge divided into sections and it may further include shields between each explosive charge section. The shields may be made of composite material and the composite material may be steel sandwiched between Lexan layers. Each explosive charge section may be wedged-shaped having a proximal surface abutting the projectile core and a distal surface. The distal surface may be tapered to reduce weight. The projectiles have a hexagon shape and the projectiles may be made of tungsten. The projectiles may have a cylindrical cross section or a non-cylindrical cross section. The projectiles may have a star-shaped cross section or a cruciform cross section. The projectiles may have flat ends. The projectiles may have a non-flat nose or a pointed nose or a wedge-shaped nose.

In another embodiment, the kinetic energy rod warhead may include means for aligning the individual projectiles when the explosive charge deploys the projectiles. The means for aligning may include a plurality of detonators spaced along the explosive charge configured to prevent sweeping shock waves at the interface of the projectile core and the explosive charge to prevent tumblings of the projectiles, and the means for aligning may also include a body in the core with orifices therein, the projectiles disposed in the orifices of the body. The body may be made of low density material. The means for aligning may include a flux compression generator which generates a magnetic alignment field to align the projectiles and there may be two flux compression generators, one on each end of the projectile core. Each flux compression generator may include a magnetic core element, a number of coils about the magnetic core element, and an explosive for the imploding the magnetic core element.

This invention also features a kinetic energy rod warhead including a projectile core that includes a plurality of individual projectiles, an explosive charge about the core, at least one detonator for the explosive charge, and an explosive sheet on each end of the projectile core and thin outer plates disposed on outer surfaces of the explosive sheets for reducing deployment angles of the projectiles.

This invention further features a kinetic energy rod warhead for reducing deployment angles of projectiles, the warhead including a projectile core that includes a plurality of individual projectiles, an explosive charge about the core, at least one detonator for the explosive charge, an explosive sheet on each end of the projectile core, a buffer between each explosive sheet and the projectile core, and an absorbing layer between each of the buffers and the projectile core.

This invention also features a kinetic energy rod warhead including a projectile core that includes a plurality of individual projectiles, an explosive charge about the core, a frangible skin about the explosive charge, at least one detonator for the explosive charge, and an explosive sheet on each end of the projectile core to reduce deployment angles of the projectile core.

This invention further features a kinetic energy rod warhead including a projectile core that includes a plurality of different size individual projectiles, an explosive charge about the core, at least one detonator for the explosive charge, and an explosive sheet on each end of the projectile core to reduce deployment angles of the projectiles.

This invention also features a kinetic energy rod warhead including a projectile core that includes a plurality of individual projectiles, an explosive charge about the core, at least one detonator for the explosive charge, an explosive sheet on each end of the projectile core to reduce deployment angles of the projectiles, and means for further reducing deployment angles of the projectiles including a buffer between the explosive charge and the core.

This invention further features a kinetic energy rod warhead including a projectile core that includes a plurality of individual projectiles, an explosive charge about the core, at least one detonator for the explosive charge, an explosive sheet on each end of the projectile core to reduce deployment angles of the projectiles, and means for aligning the individual projectiles when the explosive charge deploys the projectiles.

This invention also features a method of reducing the deployment angle of projectiles in a kinetic energy rod warhead, the method including providing a projectile core including a plurality of individual projectiles, an explosive charge about the core and at least one detonator for the explosive charge. The method also includes disposing an explosive sheet on each end of the projectile core and detonating the explosive charge detonator to detonate the explosive charge and the explosive sheets to deploy the individual projectiles at a reduced deployment angle. Each explosive sheet may be made of PBXN-109. The method may further include disposing a buffer between each explosive sheet and the projectile core, and the buffer may be made of foam. The method may further include disposing thin aluminum absorbing layers between the buffers and the projectile core, and it may further include disposing thin outer plates on outer surfaces of the explosive sheets. The thin outer plates may be made of aluminum. The method may further include attaching each explosive sheet to the explosive charge, and it may further include disposing each explosive sheet adjacent the explosive charge. Each explosive sheet may be at least one order of magnitude thinner than a steel end plate, and the method may further include structuring and arranging each explosive sheet to contain the ends of the projectile core when deployed to decrease the deployment angle of the individual projectiles.

This invention further features a method of reducing the deployment angle of projectiles in a kinetic energy rod warhead, the method including providing a projectile core including projectile bays, each bay including a plurality of individual projectiles, an explosive charge including a number of explosive charge sections about the core, and at least one detonator for each of the explosive charge sections, disposing an explosive sheet on each end of the projectile core, and detonating the explosive charge detonator.

BRIEF DESCRIPTION OF THE DRAWINGS

Other objects, features and advantages will occur to those skilled in the art from the following description of a preferred embodiment and the accompanying drawings, in which.

DISCLOSURE OF THE PREFERRED EMBODIMENT

Figure 1:
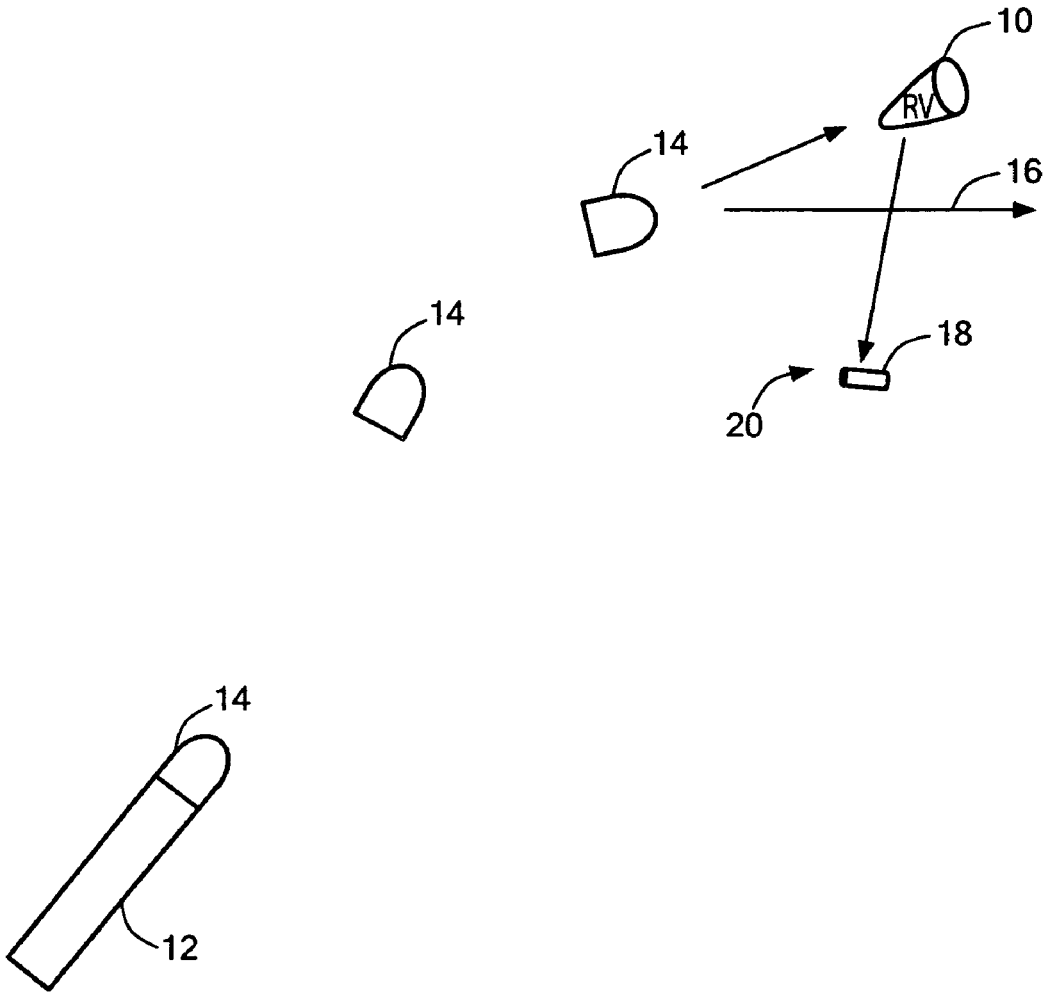
FIG. 1 PRIOR ART
FIG. 1 is schematic view showing the typical deployment of a "hit-to-kill" vehicle in accordance with the prior art.

As discussed in the Background section above, "hit-to-kill" vehicles are typically launched into a position proximate a re-entry vehicle 10, FIG. 1 or other target via a missile 12. "Hit-to-kill" vehicle 14 is navigable and designed to strike re-entry vehicle 10 to render it inoperable. Countermeasures, however, can be used to avoid the kill vehicle. Vector 16 shows kill vehicle 14 missing re-entry vehicle 10. Moreover, biological bomblets and chemical submunition payloads 18 are carried by some threats and one or more of these bomblets or chemical submunition payloads 18 can survive, as shown at 20, and cause heavy casualties even if kill vehicle 14 does accurately strike target 10.

Figure 2:
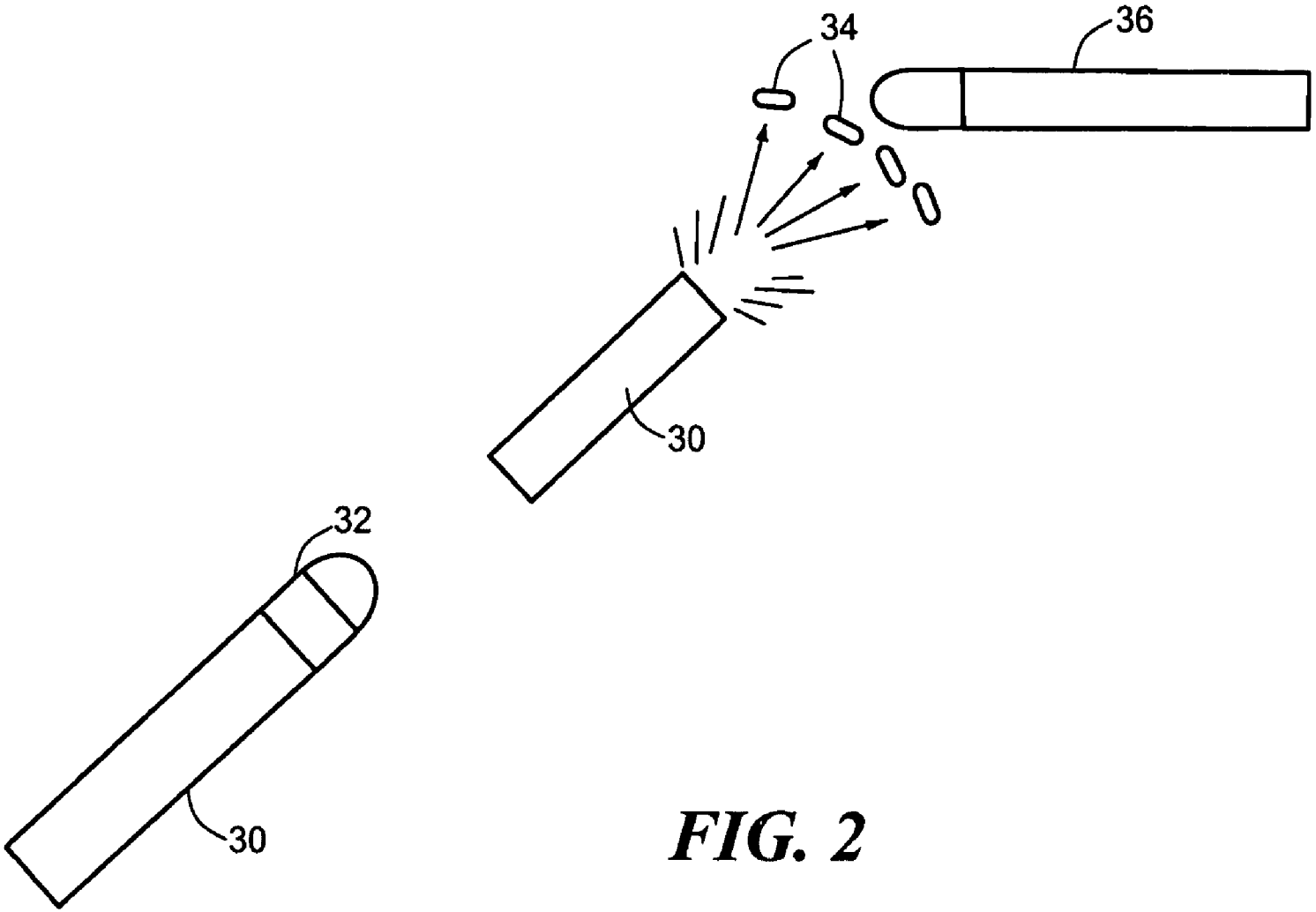
FIG. 2 PRIOR ART
FIG. 2 is schematic view showing the typical deployment of a prior art blast fragmentation type warhead.

Turning to FIG. 2, blast fragmentation type warhead 32 is designed to be carried by missile 30. When the missile reaches a position close to an enemy re-entry vehicle (RV), missile, or other target 36, a pre-made band of metal or fragments on the warhead is detonated and the pieces of metal 34 strike target 36. The fragments, however, are not always effective at destroying the submunition target and, again, biological bomblets and/or chemical submunition payloads can survive and cause heavy casualties.

The textbook by the inventor hereof, R. Lloyd, "Conventional Warhead Systems Physics and Engineering Design," Progress in Astronautics and Aeronautics (AIAA) Book Series, Vol. 179, ISBN 1-56347-255-4, 1998, incorporated herein by this reference, provides additional details concerning "hit-to-kill" vehicles and blast fragmentation type warheads. Chapter 5 of that textbook, proposes a kinetic energy rod warhead.

Figure 3:
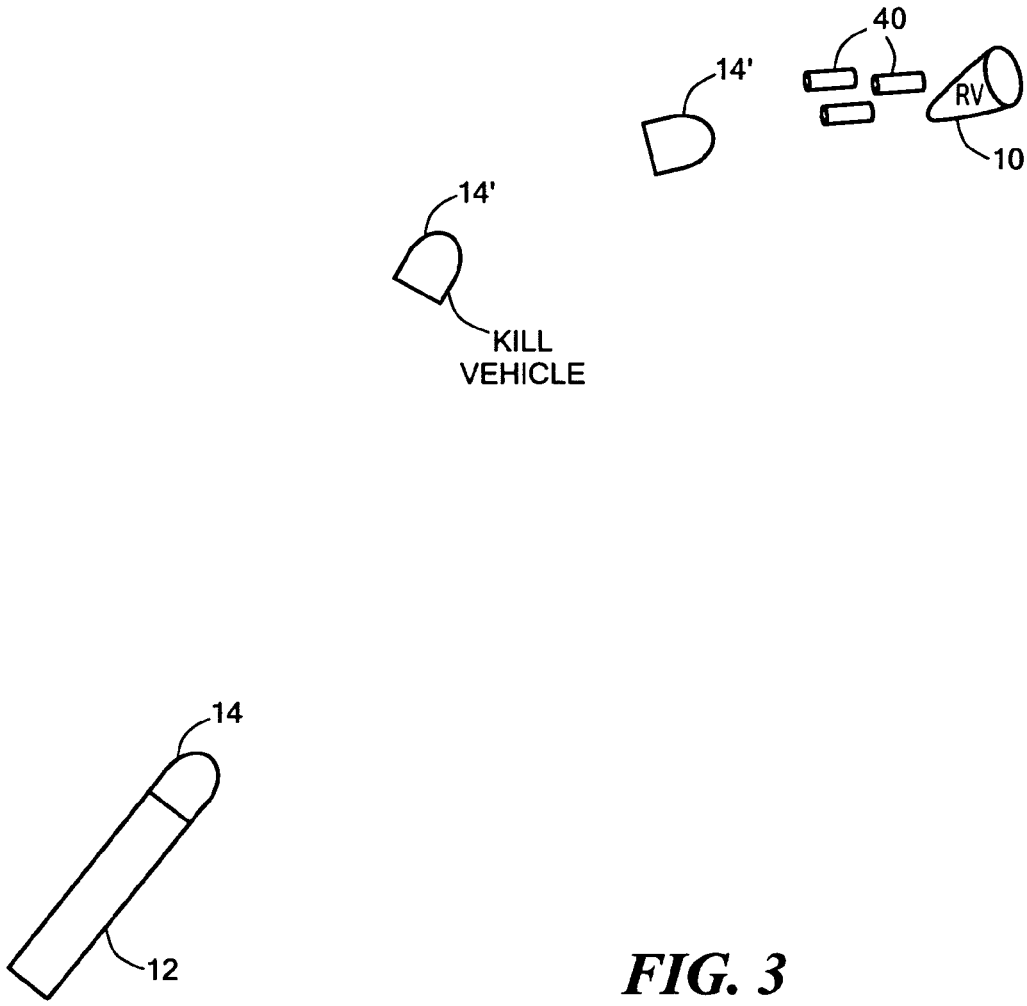
FIG. 3 is schematic view showing the deployment of a kinetic energy rod warhead system incorporated with a "hit-to-kill" vehicle in accordance with the subject invention.
Figure 4:
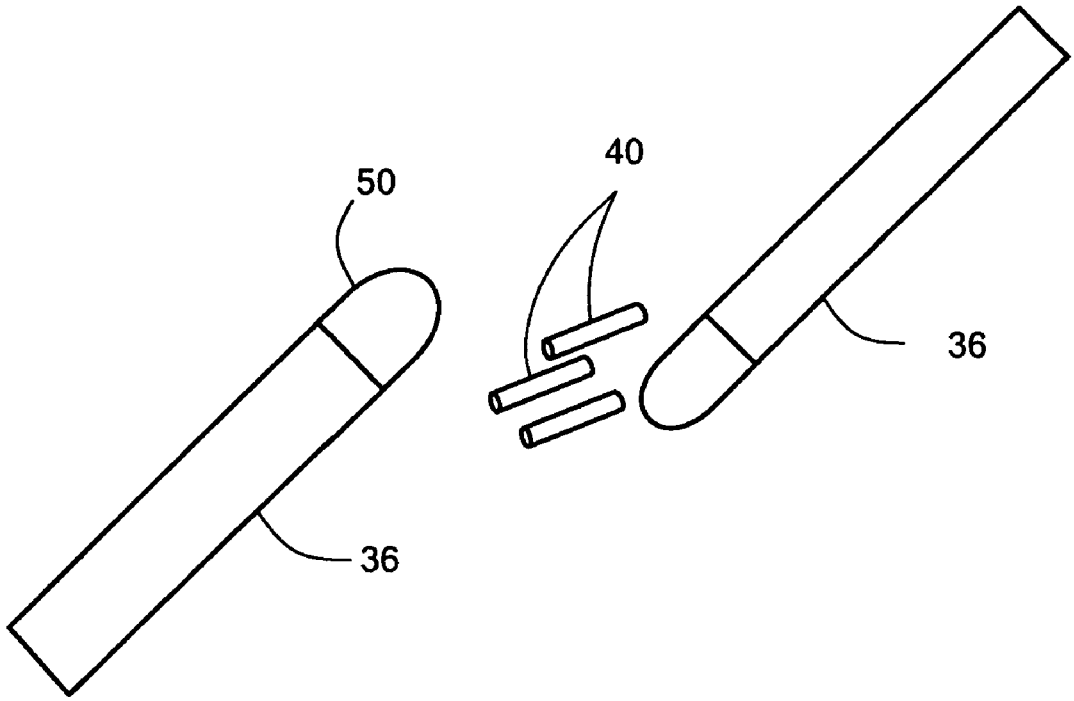
FIG. 4 is schematic view showing the deployment of a kinetic energy rod warhead as a replacement for a blast fragmentation type warhead in accordance with the subject invention.

In general, a kinetic energy rod warhead, in accordance with this invention, can be added to kill vehicle 14, FIG. 3 to deploy lengthy cylindrical projectiles 40 directed at re-entry vehicle 10 or another target. In addition, the prior art blast fragmentation type warhead shown in FIG. 2 can be replaced with or supplemented with a kinetic energy rod warhead 50, FIG. 4 to deploy projectiles 40 at target 36.

Two key advantages of kinetic energy rod warheads as theorized is that 1) they do not rely on precise navigation as is the case with "hit-to-kill" vehicles and 2) they provide better penetration then blast fragmentation type warheads.

Figure 5:
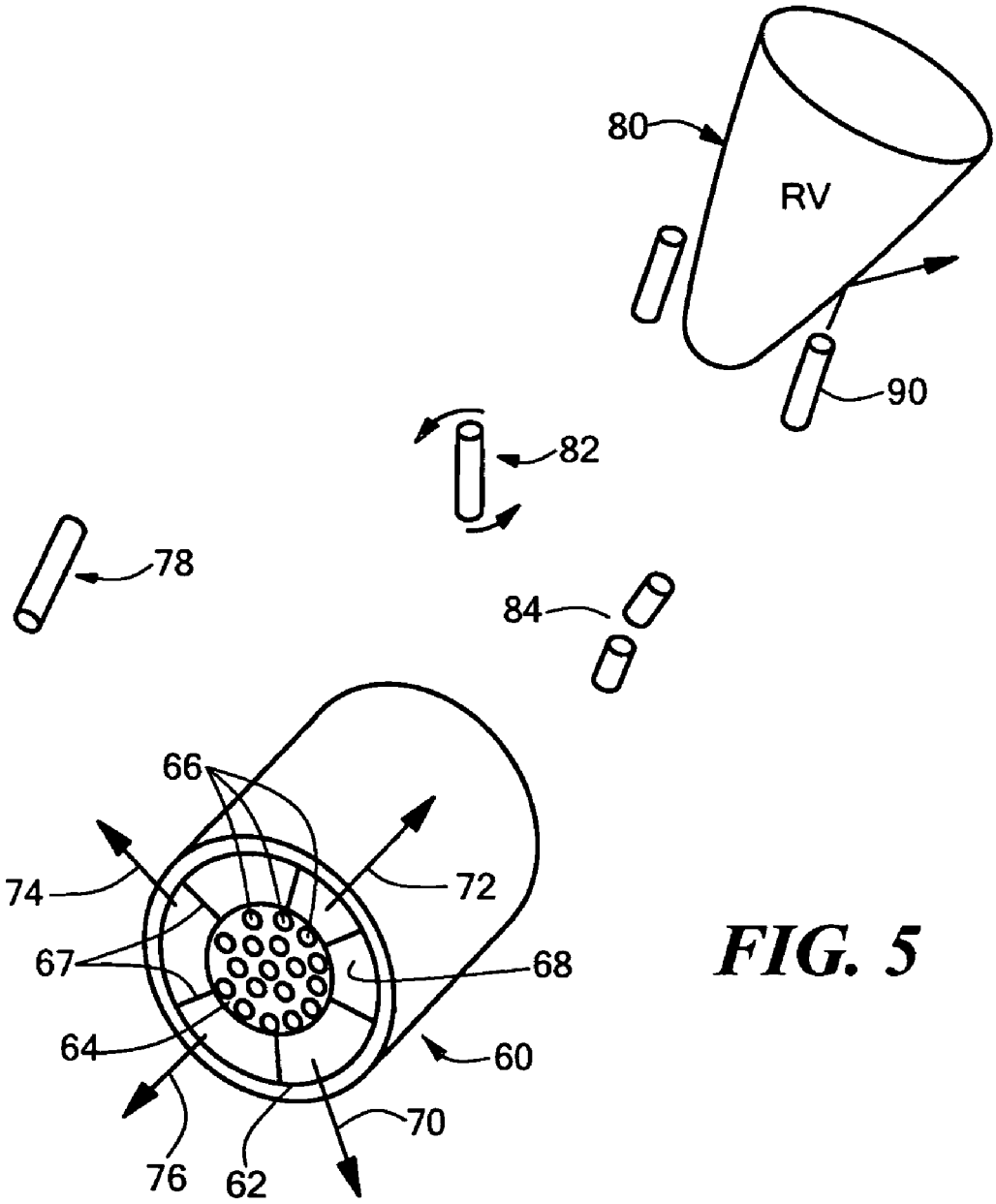
FIG. 5 is a more detailed view showing the deployment of the projectiles of a kinetic energy rod warhead at a target in accordance with the subject invention.

To date, however, kinetic energy rod warheads have not been widely accepted nor have they yet been deployed or fully designed. The primary components associated with a theoretical kinetic energy rod warhead 60, FIG. 5 is hull 62, projectile core or bay 64 in hull 62 including a number of individual lengthy cylindrical rod projectiles 66, sympathetic shield 67, and explosive charge 68 in hull 62 about bay or core 64. When explosive charge 68 is detonated, projectiles 66 are deployed as shown by vectors 70, 72, 74, and 76.

Note, however, that in FIG. 5 the projectile shown at 78 is not specifically aimed or directed at re-entry vehicle 80. Note also that the cylindrical shaped projectiles may tend to break upon deployment as shown at 84. The projectiles may also tend to tumble in their deployment as shown at 82. Still other projectiles approach target 80 at such a high oblique angle that they do not penetrate target 80 effectively as shown at 90.

In this invention, the kinetic energy rod warhead includes, inter alia, means for aligning the individual projectiles when the explosive charge is detonated and deploys the projectiles to prevent them from tumbling and to insure the projectiles approach the target at a better penetration angle.

Figure 6:
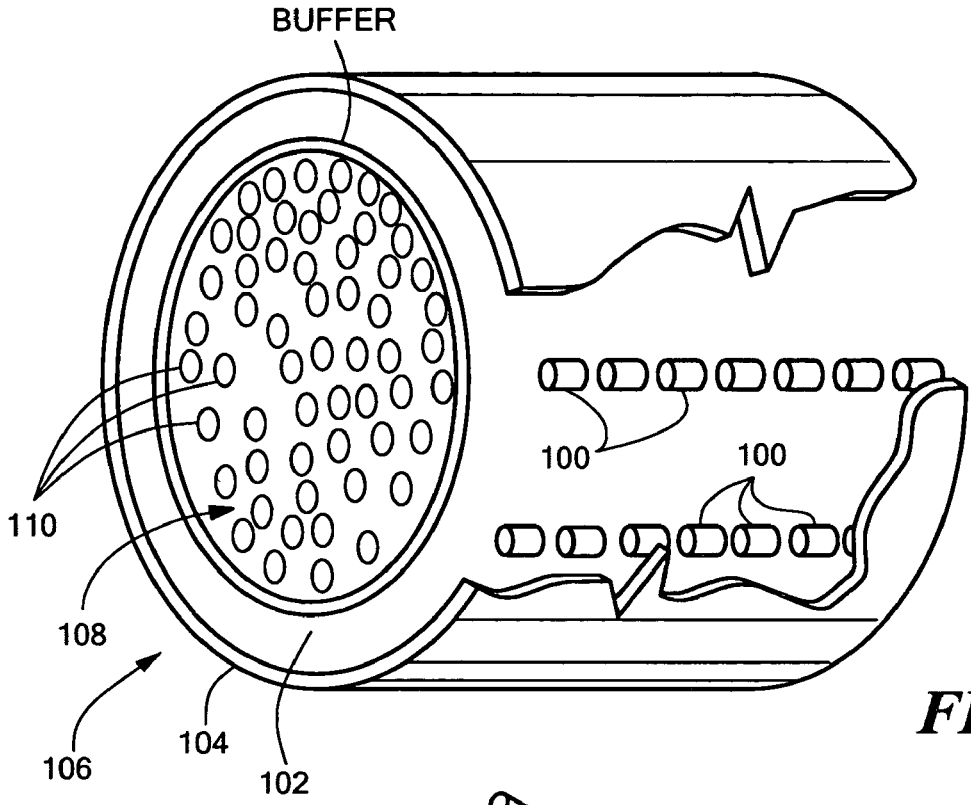
FIG. 6 is three-dimensional partial cut-away view of one embodiment of the kinetic energy rod warhead system of the subject invention.

In one example, the means for aligning the individual projectiles include a plurality of detonators 100, FIG. 6 (typically chip slapper type detonators) spaced along the length of explosive charge 102 in hull 104 of kinetic energy rod warhead 106. As shown in FIG. 6, projectile core 108 includes many individual lengthy cylindrical projectiles 110 and, in this example, explosive charge 102 surrounds projectile core 108. By including detonators 100 spaced along the length of explosive charge 102, sweeping shock waves are prevented at the interface between projectile core 108 and explosive charge 102 which would otherwise cause the individual projectiles 110 to tumble.

Figure 7:
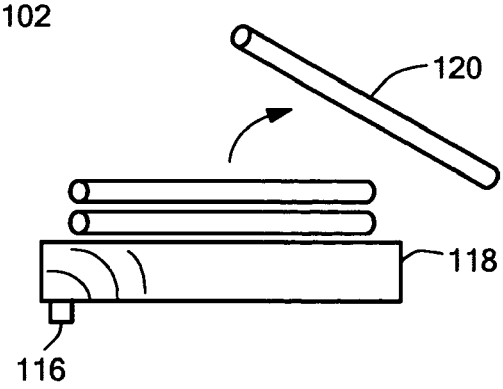
FIG. 7 is schematic cross-sectional view showing a tumbling projectile in accordance with prior kinetic energy rod warhead designs.

As shown in FIG. 7, if only one detonator 116 is used to detonate explosive 118, a sweeping shockwave is created which causes projectile 120 to tumble. When this happens, projectile 120 can fracture, break or fail to penetrate a target which lowers the lethality of the kinetic energy rod warhead.

By using a plurality of detonators 100 spaced along the length of explosive charge 108, a sweeping shock wave is prevented and the individual projectiles 100 do not tumble as shown at 122.

Figure 9:
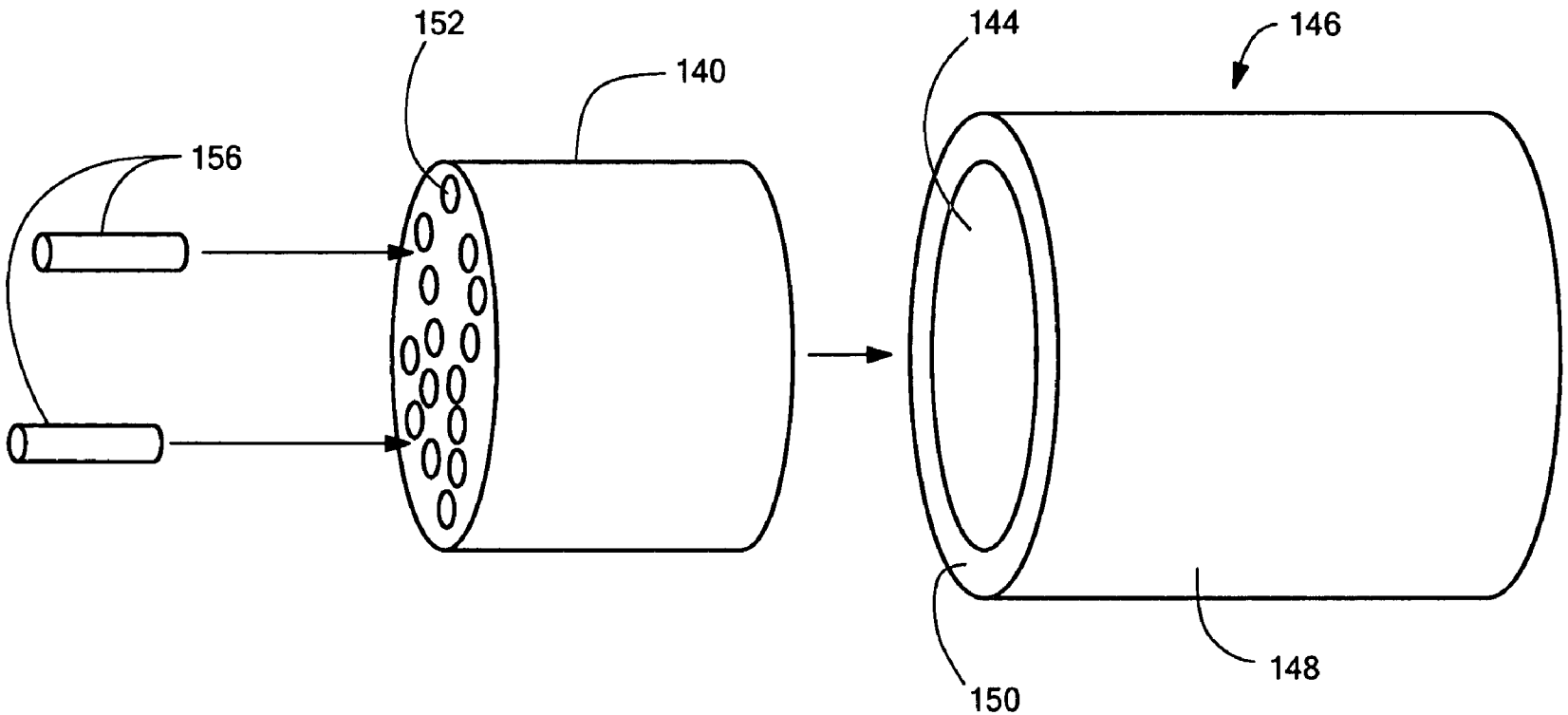
FIG. 9 is an exploded schematic three-dimensional view showing the use of a kinetic energy rod warhead core body used to align the projectiles in accordance with the subject invention.

In another example, the means for aligning the individual projectiles includes low density material (e.g., foam) body 140, FIG. 9 disposed in core 144 of kinetic energy rod warhead 146 which, again, includes hull 148 and explosive charge 150. Body 140 includes orifices 152 therein which receive projectiles 156 as shown. The foam matrix acts as a rigid support to hold all the rods together after initial deployment. The explosive accelerates the foam and rods toward the RV or other target. The foam body holds the rods stable for a short period of time keeping the rods aligned. The rods stay aligned because the foam reduces the explosive gases venting through the packaged rods.

Figure 8:
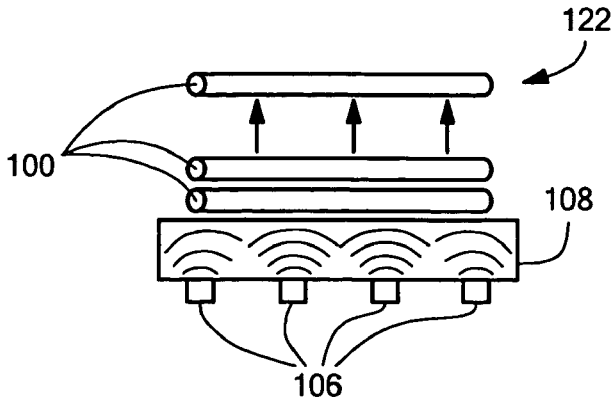
FIG. 8 is another schematic cross-sectional view showing how the use of multiple detonators aligns the projectiles to prevent tumbling thereof in accordance with the subject invention.

In one embodiment, foam body 140, FIG. 9 maybe combined with the multiple detonator design of FIGS. 6 and 8 for improved projectile alignment.

Figure 10:
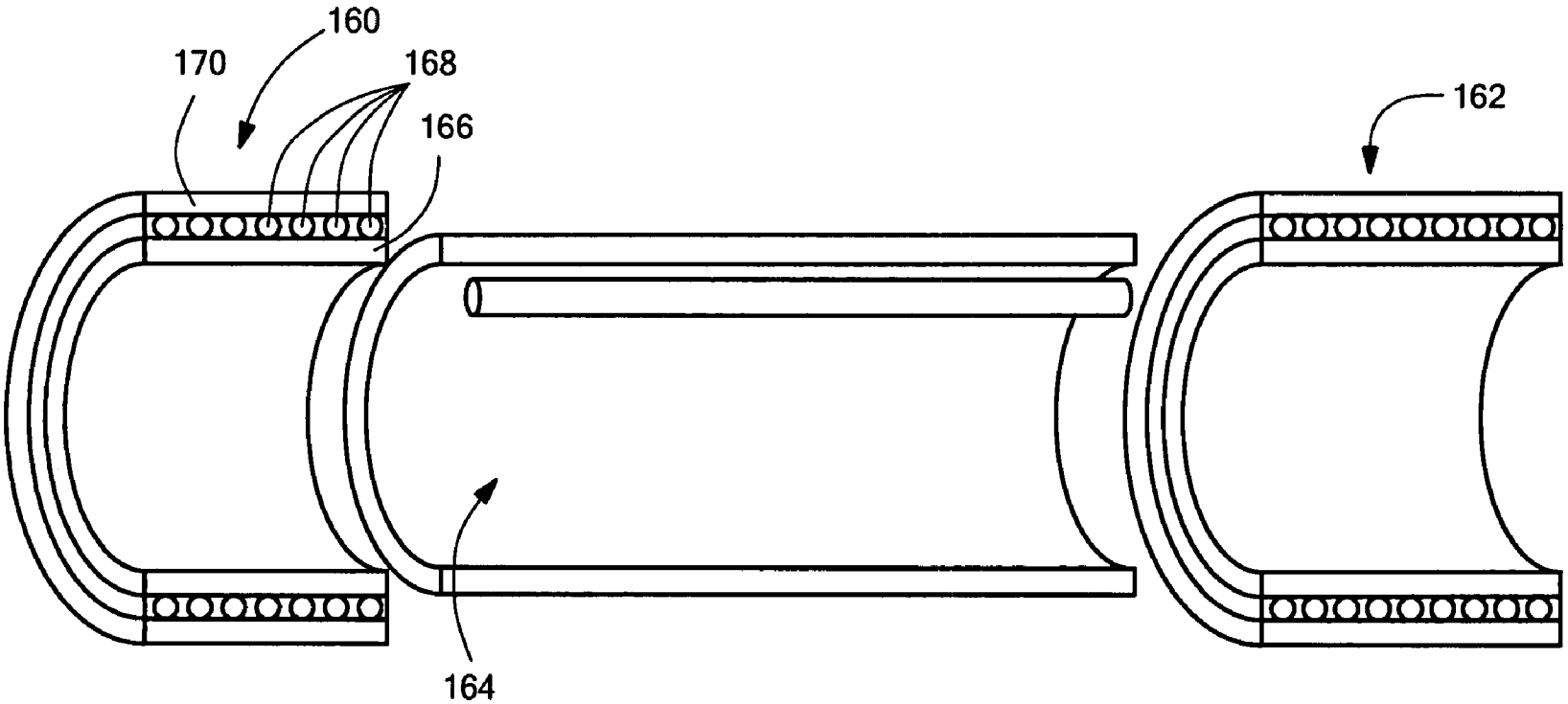
FIGS. 10 and 11 are schematic cut-away views showing the use of flux compression generators used to align the projectiles of the kinetic energy rod warhead in accordance with the subject invention.

In still another example, the means for aligning the individual projectiles to prevent tumbling thereof includes flux compression generators 160 and 162, FIG. 10, one on each end of projectile core 164 each of which generate a magnetic alignment field to align the projectiles. Each flux compression generator includes magnetic core element 166 as shown for flux compression generator 160, a number of coils 168 about core element 166, and explosive charge 170 which implodes magnetic core element when explosive charge 170 is detonated. The specific design of flux compression generators is known to those skilled in the art and therefore no further details need be provided here.

Figure 11:
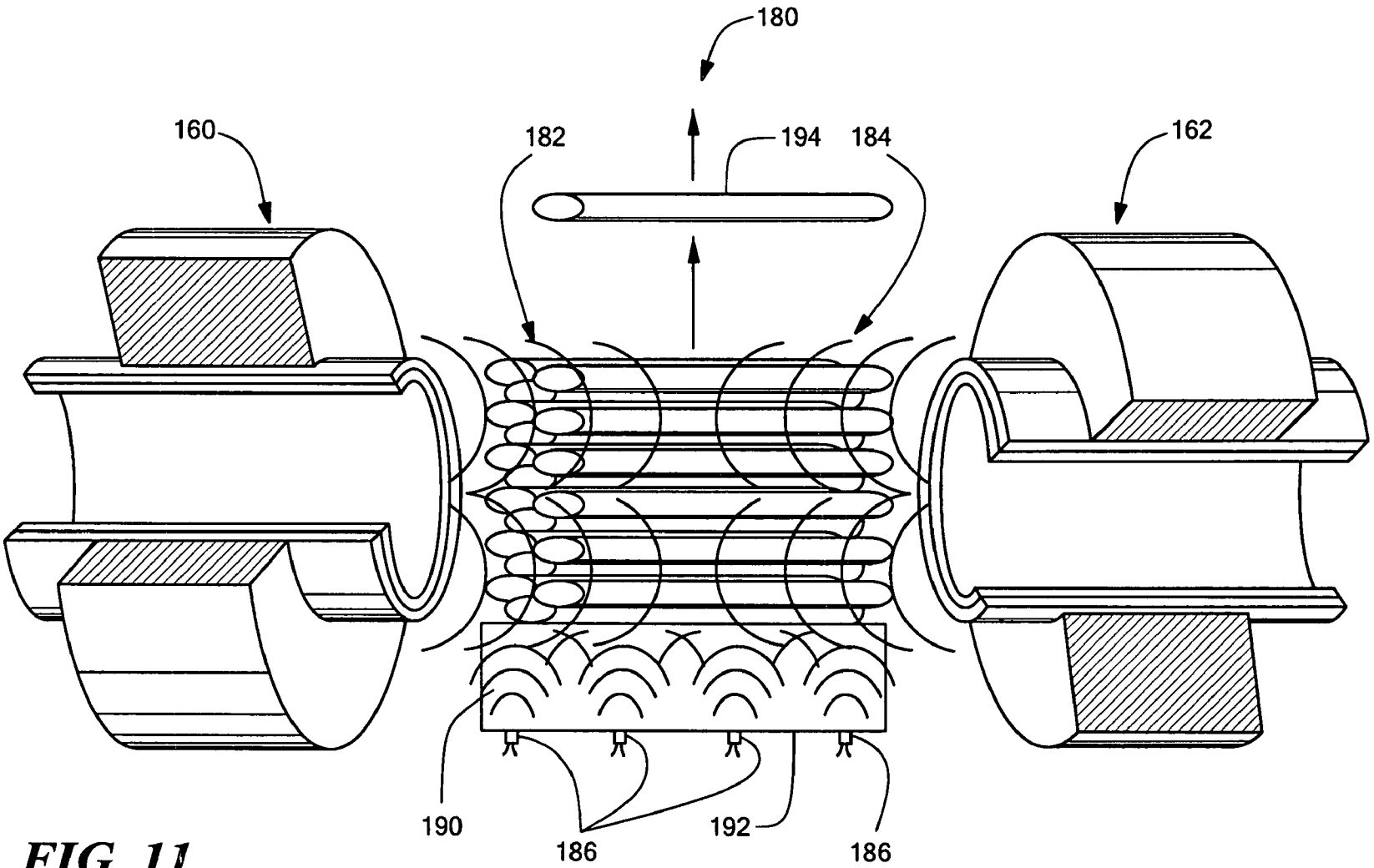

As shown in FIG. 11, kinetic energy rod warhead 180 includes flux compression generators 160 and 162 which generate the alignment fields shown at 182 and 184 and also multiple detonators 186 along the length of explosive charge 190 which generate a flat shock wave front as shown at 192 to align the projectiles at 194. As stated above, foam body 140 may also be included in this embodiment to assist with projectile alignment.

Figure 12:
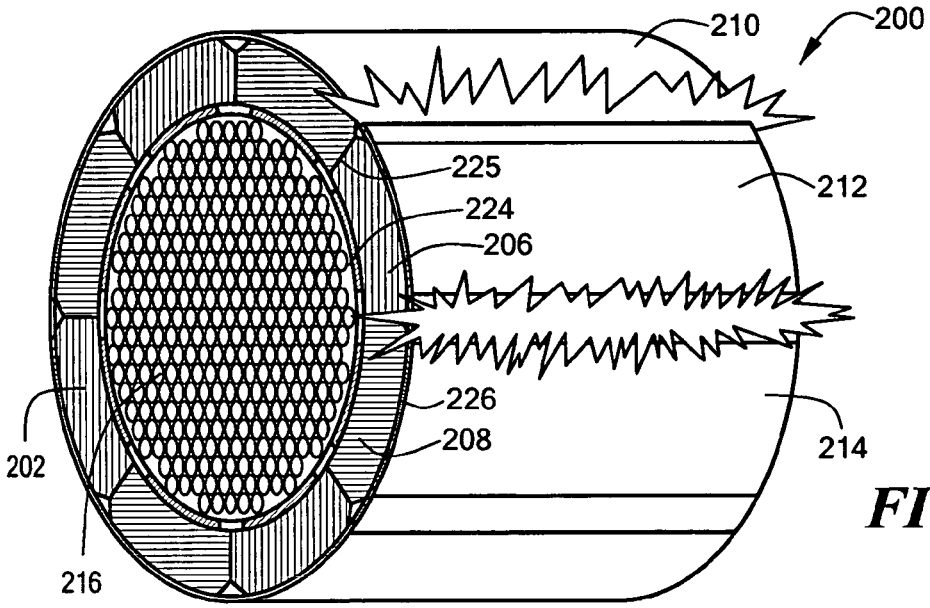
FIGS. 12-15 are schematic three-dimensional views showing how the projectiles of the kinetic energy rod warhead of the subject invention are aimed in a particular direction in accordance with the subject invention.
Figure 13:
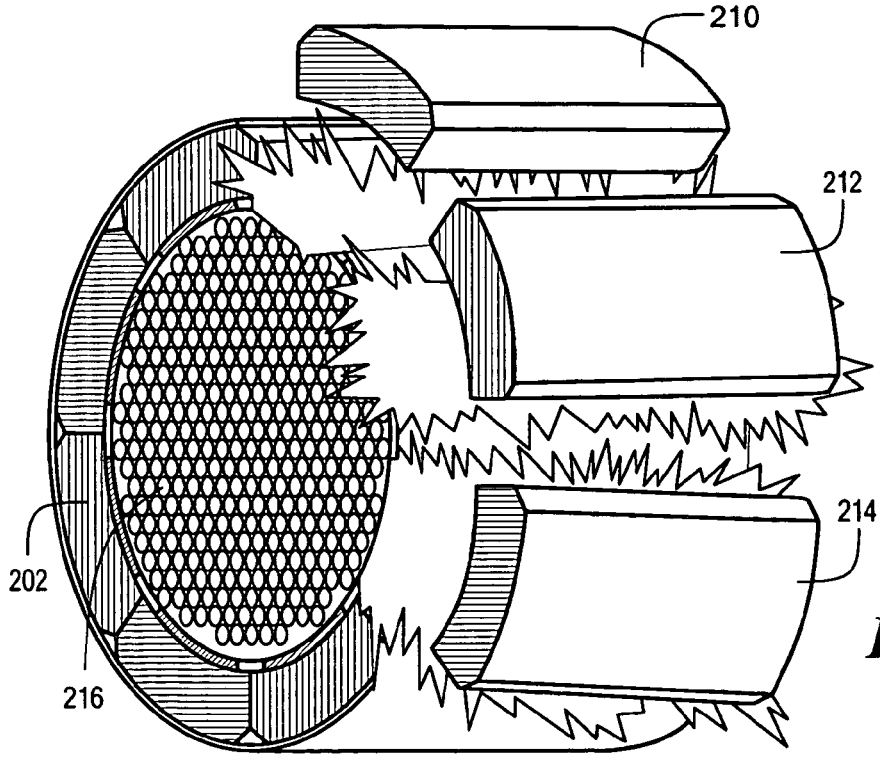
Figure 14:
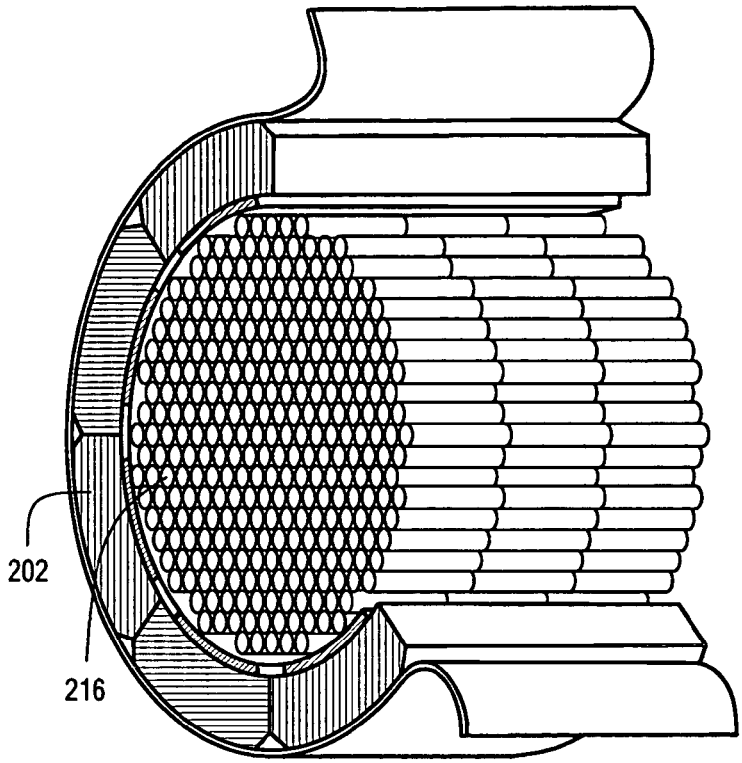
Figure 15:
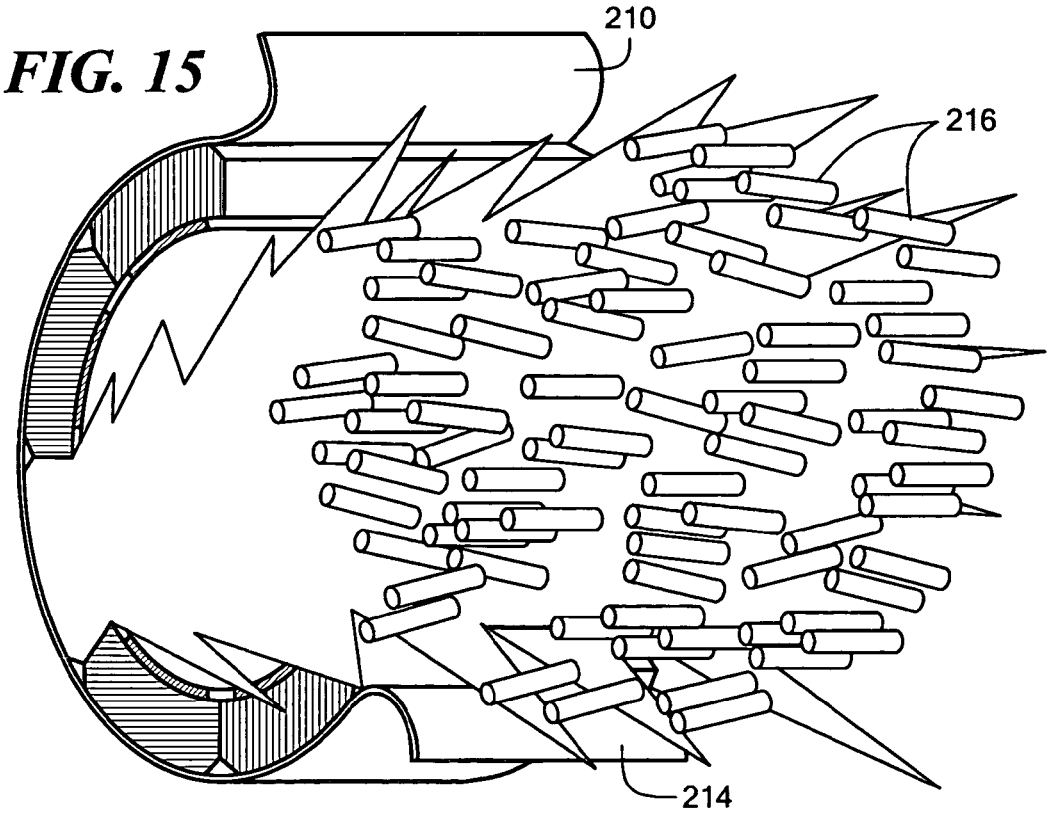

In FIG. 12, kinetic energy rod warhead 200 includes an explosive charge divided into a number of sections 202, 204, 206, and 208. Shields such as shield 225 separates explosive charge sections 204 and 206. Shield 225 maybe made of a composite material such as a steel core sandwiched between inner and outer lexan layers to prevent the detonation of one explosive charge section from detonating the other explosive charge sections. Detonation cord resides between hull sections 210, 212, and 214 each having a jettison explosive pack 220, 224, and 226. High density tungsten rods 216 reside in the core or bay of warhead 200 as shown. To aim all of the rods 216 in a specific direction and therefore avoid the situation shown at 78 in FIG. 5, the detonation cord on each side of hull sections 210, 212, and 214 is initiated as are jettison explosive packs 220, 222, and 224 as shown in FIGS. 13-14 to eject hull sections 210, 212, and 214 away from the intended travel direction of projectiles 216. Explosive charge section 202, FIG. 14 is then detonated as shown in FIG. 15 using a number of detonators as discussed with reference to FIGS. 6 and 8 to deploy projectiles 216 in the direction of the target as shown in FIG. 15. Thus, by selectively detonating one or more explosive charge sections, the projectiles are specifically aimed at the target in addition to being aligned using the aligning structures shown and discussed with reference to FIGS. 6 and 8 and/or FIG. 9 and/or FIG. 10.

In addition, the structure shown in FIGS. 12-15 assists in controlling the spread pattern of the projectiles. In one example, the kinetic energy rod warhead of this invention employs all of the alignment techniques shown in FIGS. 6 and 8-10 in addition to the aiming techniques shown in FIGS. 12-15.

Typically, the hull portion referred to in FIGS. 6-9 and 12-15 is either the skin of a missile (see FIG. 4) or a portion added to a "hit-to-kill" vehicle (see FIG. 3). Further details of the frangible skin employed in the kinetic energy rod warhead of this invention are discussed in detail below.

Figure 16:
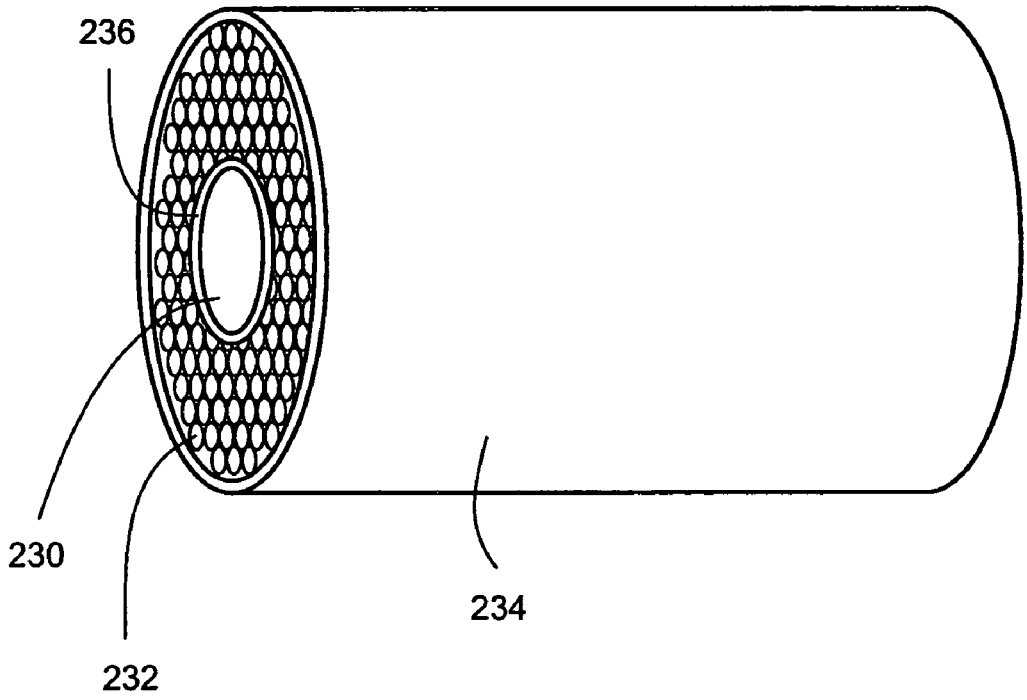
FIG. 16 is a three-dimensional schematic view showing another embodiment of the kinetic energy rod warhead of the subject invention.
Figure 22:
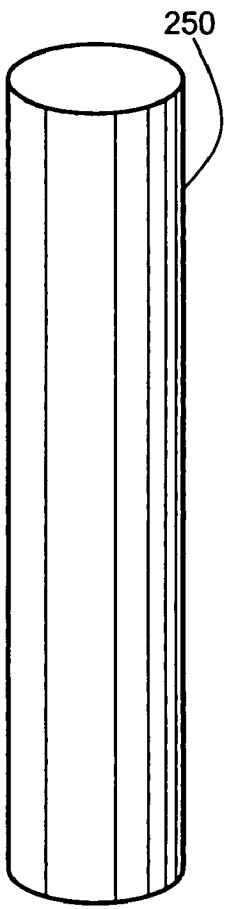
FIGS. 17-23 are three-dimensional views showing different projectile shapes useful in the kinetic energy rod warhead of the subject invention.
Figure 21:
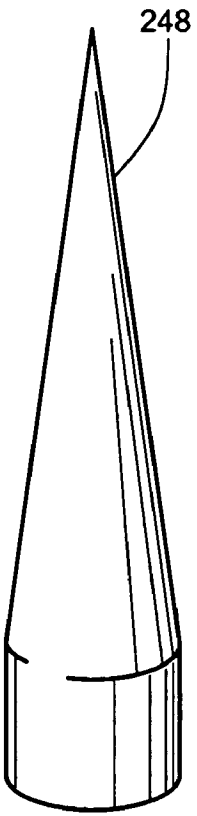
Figure 20:
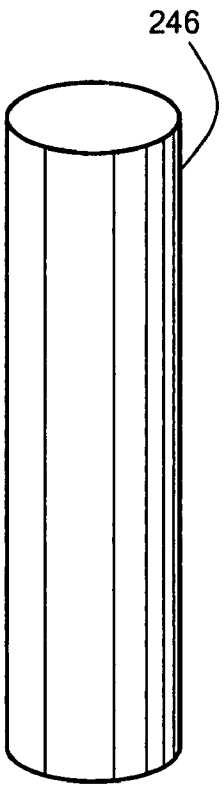
Figure 19:
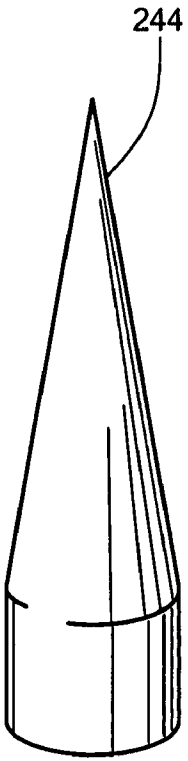
Figure 18:
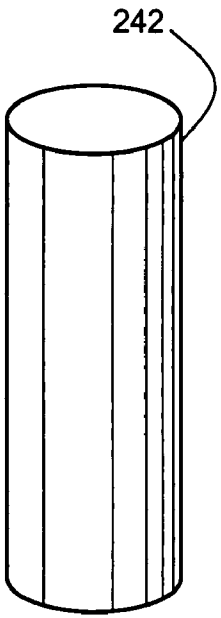
Figure 17:
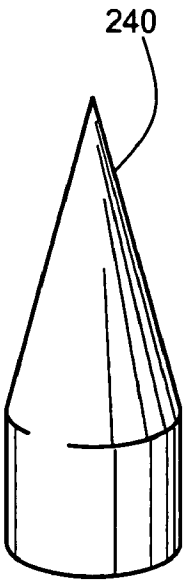
Figure 23:
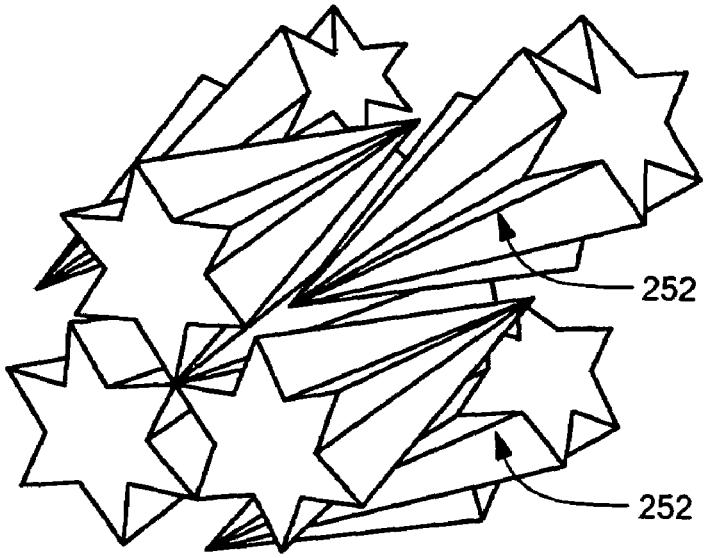

Thus far, the explosive charge is shown disposed about the outside of the projectile or rod core. In another example, however, explosive charge 230, FIG. 16 is disposed inside rod core 232 within hull 234. Further included may be low density material (e.g., foam) buffer material 236 between core 232 and explosive charge 230 to prevent breakage of the projectile rods when explosive charge 230 is detonated.

Thus far, the rods and projectiles disclosed herein have been shown as lengthy cylindrical members made of tungsten, for example, and having opposing flat ends. In another example, however, the rods have a non-cylindrical cross section and non-flat noses. As shown in FIGS. 17-24, these different rod shapes provide higher strength, less weight, and increased packaging efficiency. They also decrease the chance of a ricochet off a target to increase target penetration especially when used in conjunction with the alignment and aiming methods discussed above.

Figure 24:
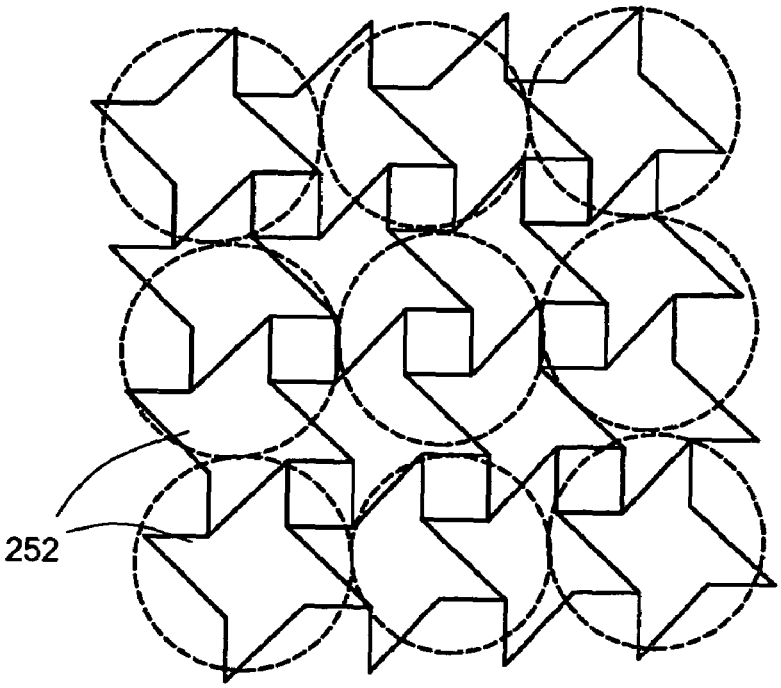
FIG. 24 is an end view showing a number of star-shaped projectiles in accordance with the subject invention and the higher packing density achieved by the use thereof.

Typically, the preferred projectiles do not have a cylindrical cross section and instead may have a star-shaped cross section, a cruciform cross section, or the like. Also, the projectiles may have a pointed nose or at least a non-flat nose such as a wedge-shaped nose. Projectile 240, FIG. 17 has a pointed nose while projectile 242, FIG. 18 has a star-shaped nose. Other projectile shapes are shown at 244, FIG. 19 (a star-shaped pointed nose); projectile 246, FIG. 20; projectile 248, FIG. 21; and projectile 250, FIG. 22. Projectiles 252, FIG. 23 have a star-shaped cross section, pointed noses, and flat distal ends. The increased packaging efficiency of these specially shaped projectiles is shown in FIG. 24 where sixteen star-shaped projectiles can be packaged in the same space previously occupied by nine penetrators or projectiles with a cylindrical shape.

Figure 25:
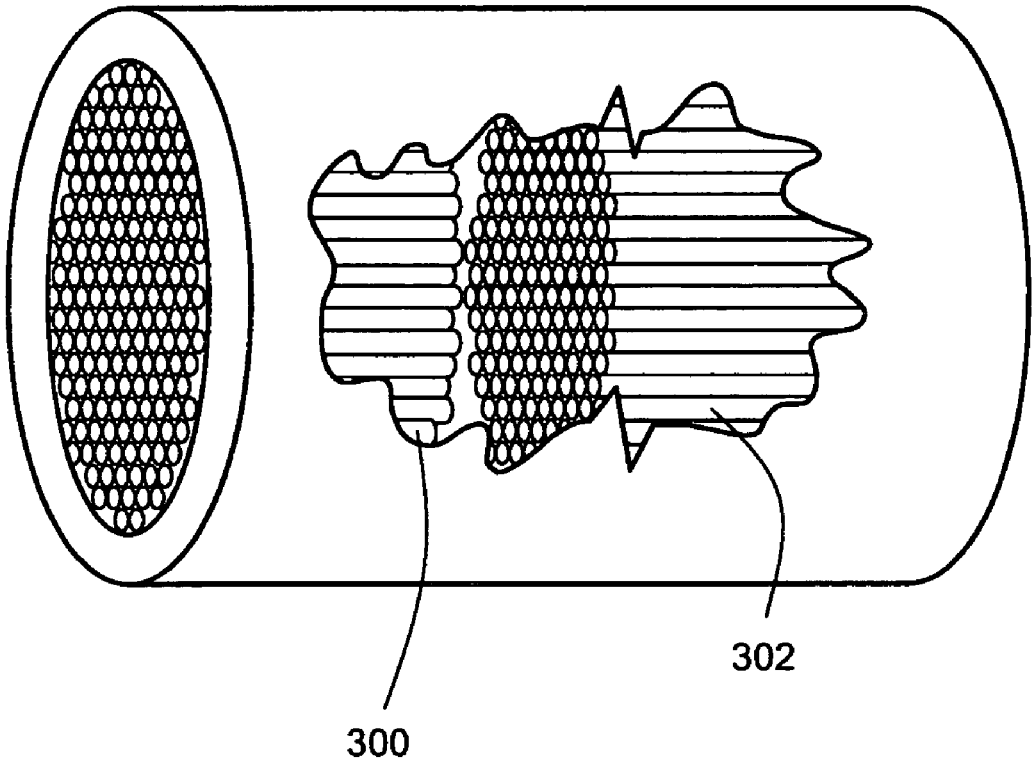
FIG. 25 is another schematic three-dimensional partially cut-away view of another embodiment of the kinetic energy rod warhead system of the subject invention wherein there are a number of projectile bays.
Figure 26:
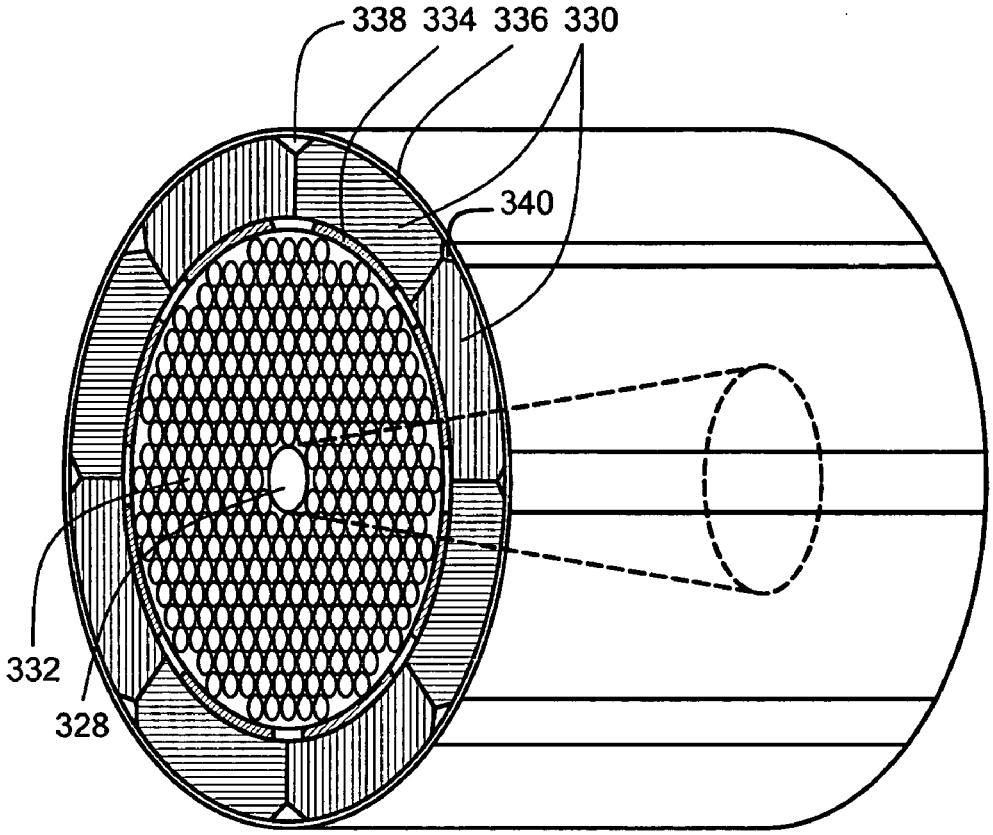
FIG. 26 is another three-dimensional schematic view showing an embodiment of the kinetic energy rod warhead system of this invention wherein the explosive core is wedge shaped to provide a uniform projectile spray pattern in accordance with the subject invention.
Figure 27:
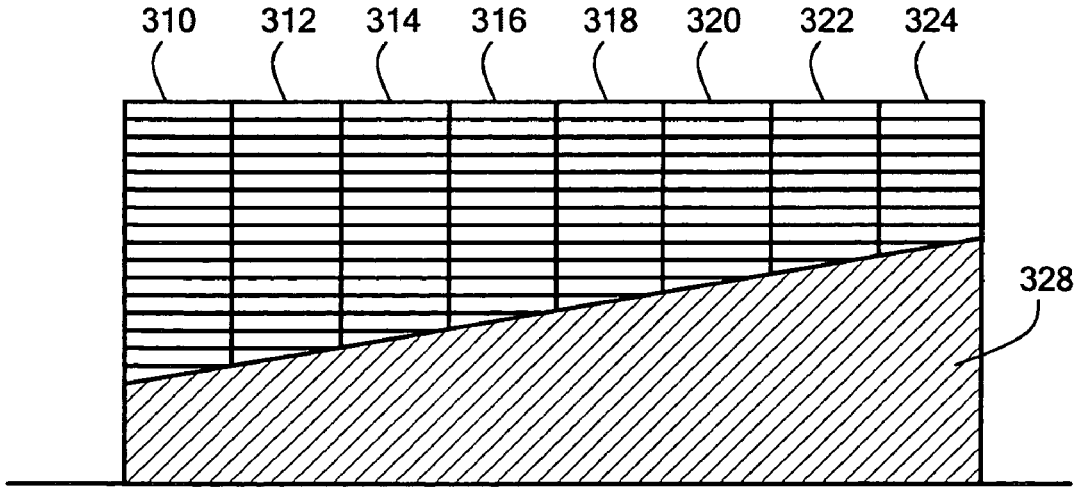
FIG. 27 is a cross sectional view showing a wedge shaped explosive core and bays of projectiles adjacent it for the kinetic energy rod warhead system shown in FIG. 26.

Thus far, it is assumed there is only one set of projectiles. In another example, however, the projectile core is divided into a plurality of bays 300 and 302, FIG. 25. Again, this embodiment may be combined with the embodiments shown in FIGS. 6 and 8-24. In FIGS. 26 and 27, there are eight projectile bays 310-324 and cone shaped explosive core 328 which deploys the rods of all the bays at different velocities to provide a uniform spray pattern. Also shown in FIG. 26 is wedged shaped explosive charge sections 330 with narrower proximal surface 334 abutting projectile core 332 and broader distal surface 336 abutting the hull of the kinetic energy rod warhead. Distal surface 336 is tapered as shown at 338 and 340 to reduce the weight of the kinetic energy rod warhead.

Figure 28:
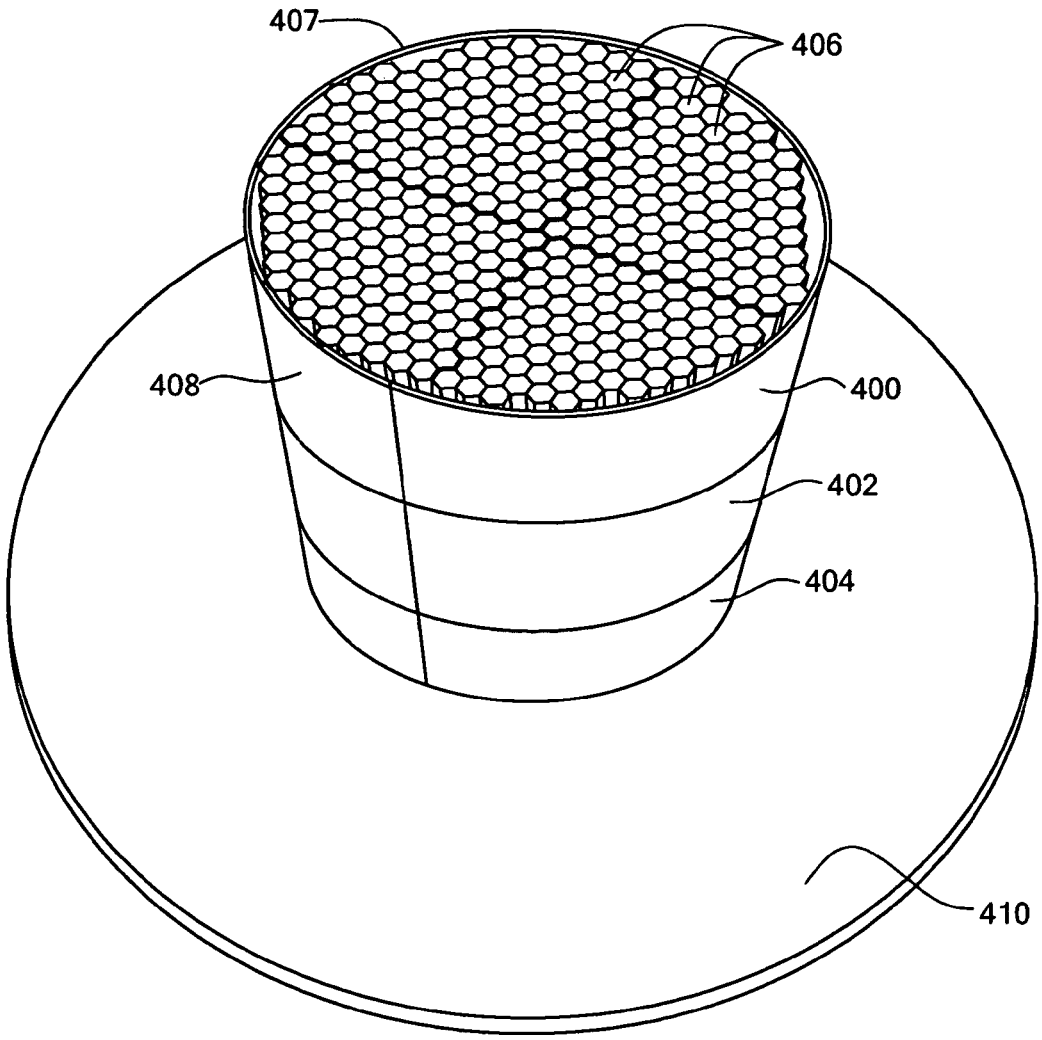
FIG. 28 is a schematic depiction of a test version of a kinetic energy rod warhead in accordance with the subject invention with three separate rod bays.

In one test example, the projectile core included three bays 400, 402 and 404, FIG. 28 of hexagon shaped tungsten projectiles 406. The other projectile shapes shown in FIGS. 17-24 may also be used. Each bay was held together by fiberglass wrap 408 as shown for bay 400. The bays 400, 402 and 404 rest on steel end plate 410. Buffer 407 is inserted around the rod core. This buffer reduces the explosive edge effects acting against the outer rods. By mitigating the energy acting on the edge rods it will reduce the spray angle from the explosive shock waves.

Figure 29:
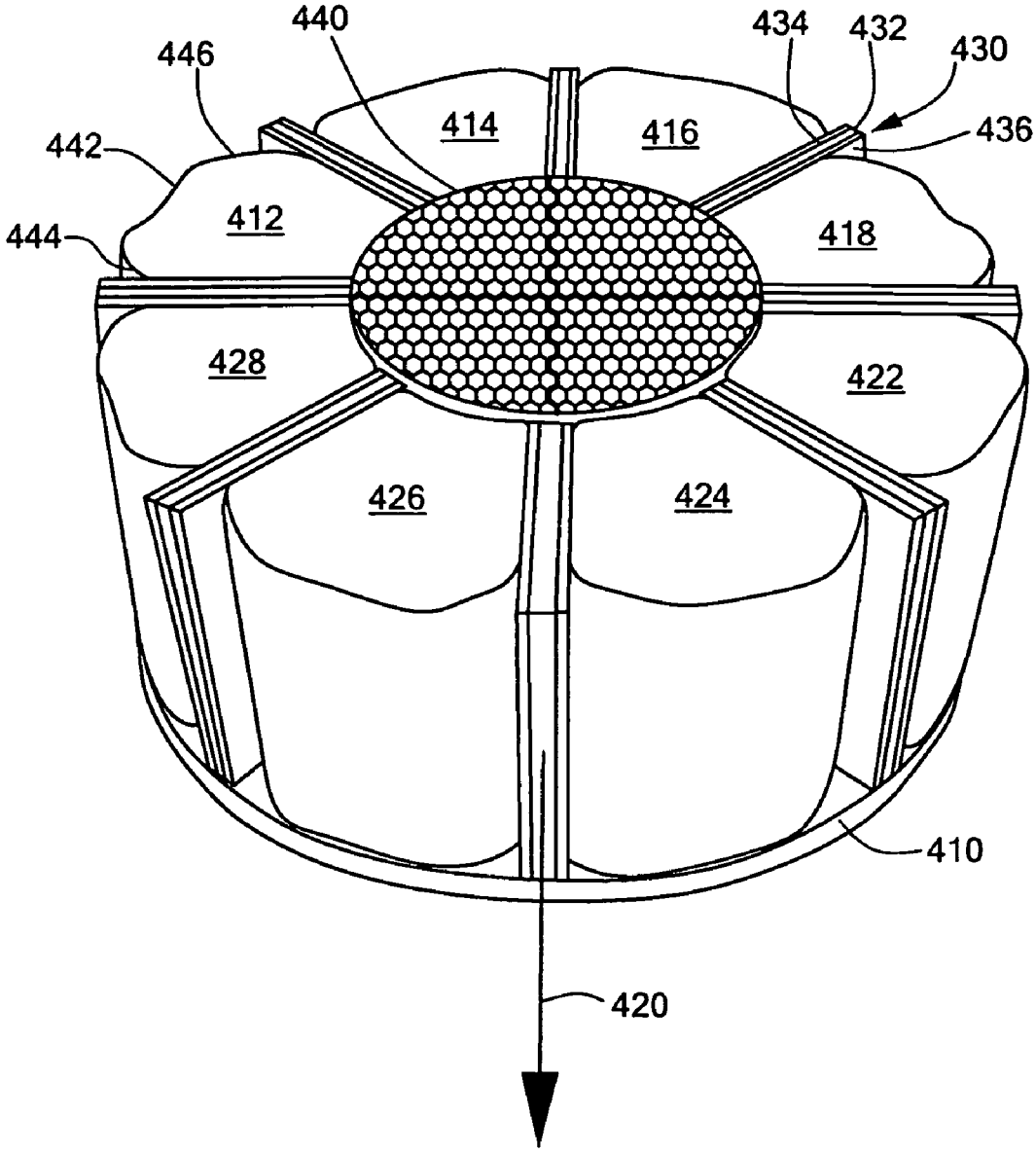
FIG. 29 is a schematic depiction of the warhead of FIG. 28 after the explosive charge sections are added.

Next, explosive charge sections 412, 414, 416 and 418, FIG. 29 were disposed on end plate 410 about the projectile core. Thus, the primary firing direction of the projectiles in this test example was along vector 420. Clay sections 422, 424, 426 and 428 simulated the additional explosive sections that would be used in a deployed warhead. Between each explosive charge section is sympathetic shield 430 typically comprising steel layer 432 sandwiched between layers of Lexan 434 and 436. Each explosive charge section is wedge shaped as shown with proximal surface 440 of explosive charge section 412 abutting the projectile core and distal surface 442 which is tapered as shown at 444 and 446 to reduce weight.

Figure 30:
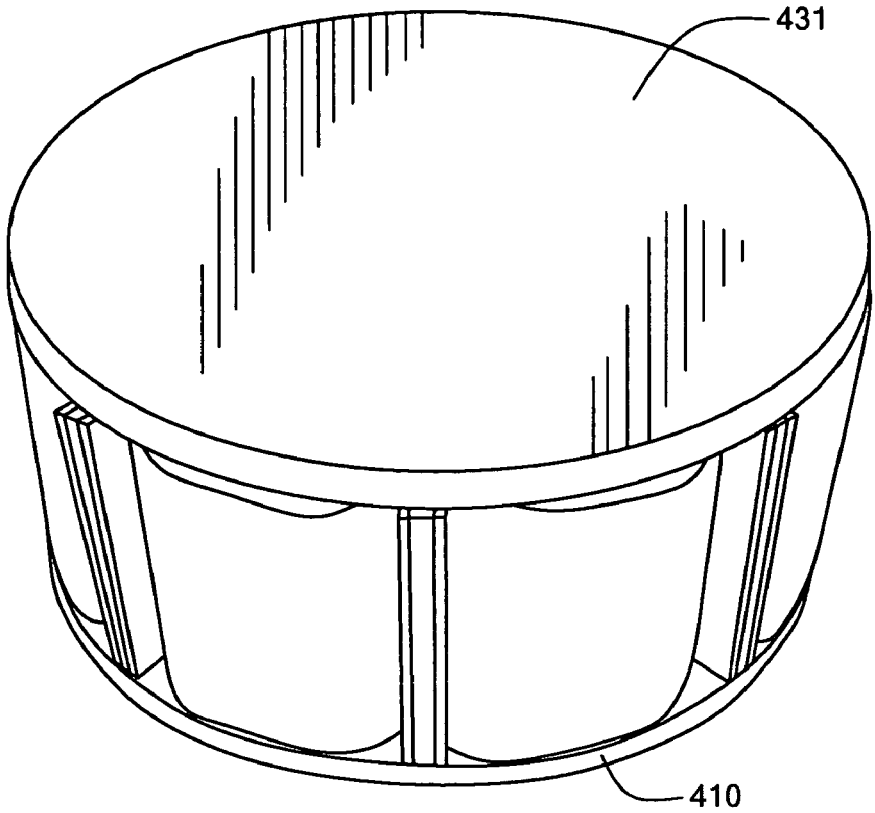
FIG. 30 is a schematic depiction of the rod warhead shown in FIGS. 28 and 29 after the addition of the top end plate.

Top end plate 431, FIG. 30 completes the assembly. End plates 410 and 431 could also be made of aluminum. The total weight of the projectile rods 406 was 65 pounds, the weight of the C4 explosive charge sections 412, 414, 416, and 418 was 10 pounds. Each rod weighed 35 grams and had a length to diameter ratio of 4. 271 rods were packaged in each bay with 823 rods total. The total weight of the assembly was 30.118 pounds.

Figure 31:
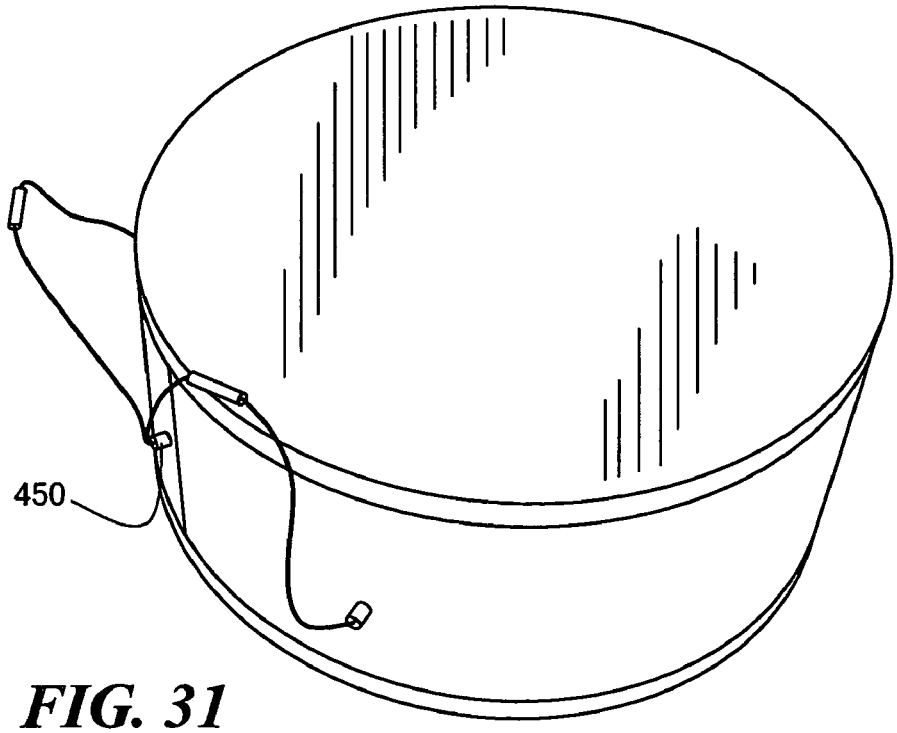
FIG. 31 is a schematic view of the kinetic energy rod warhead of FIG. 30 just before a test firing.
Figure 32:
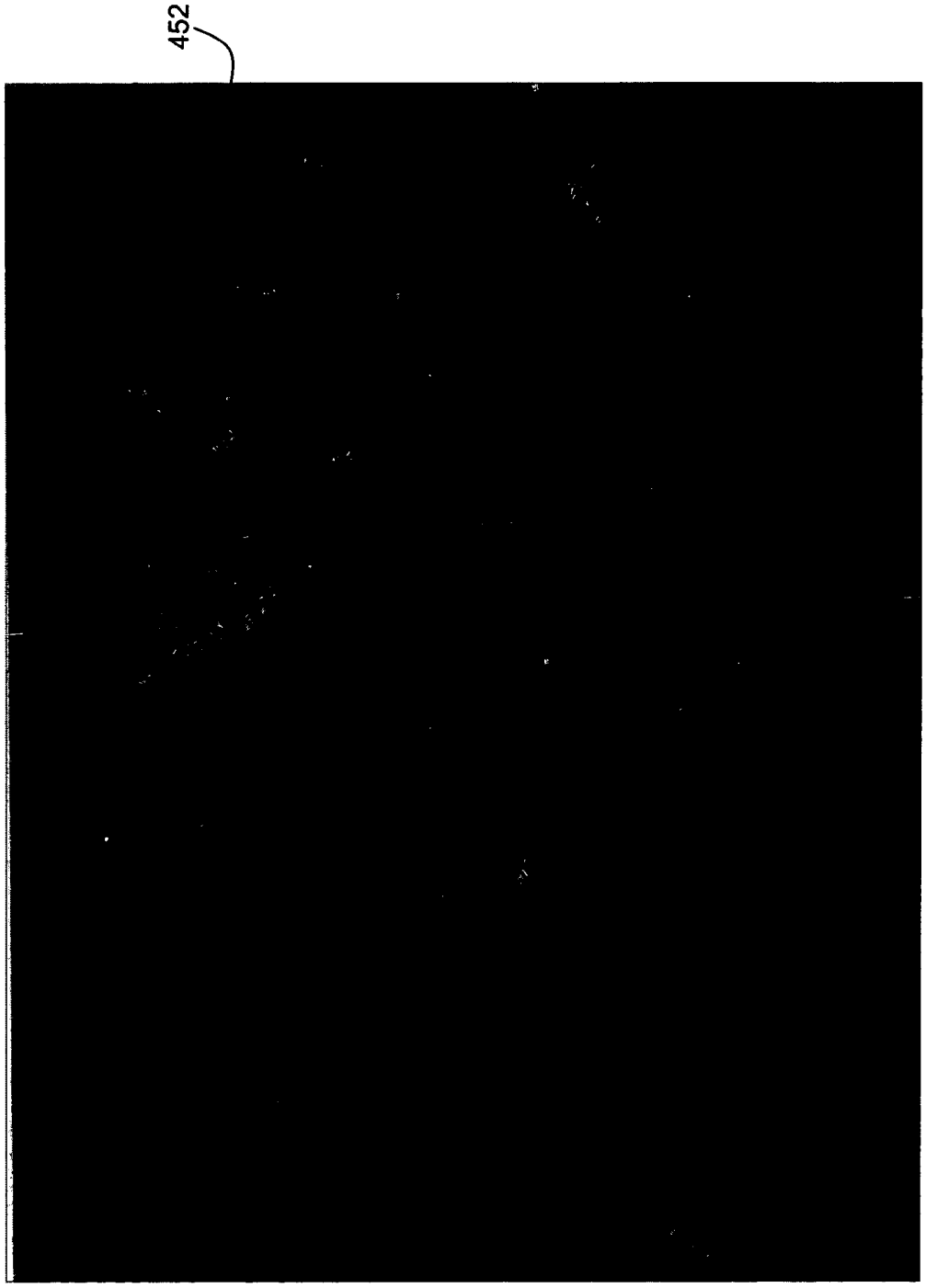
FIG. 32 is a schematic view showing the results of the impact of the individual rods after the test firing of the warhead showing in FIG. 31.
Figure 33:
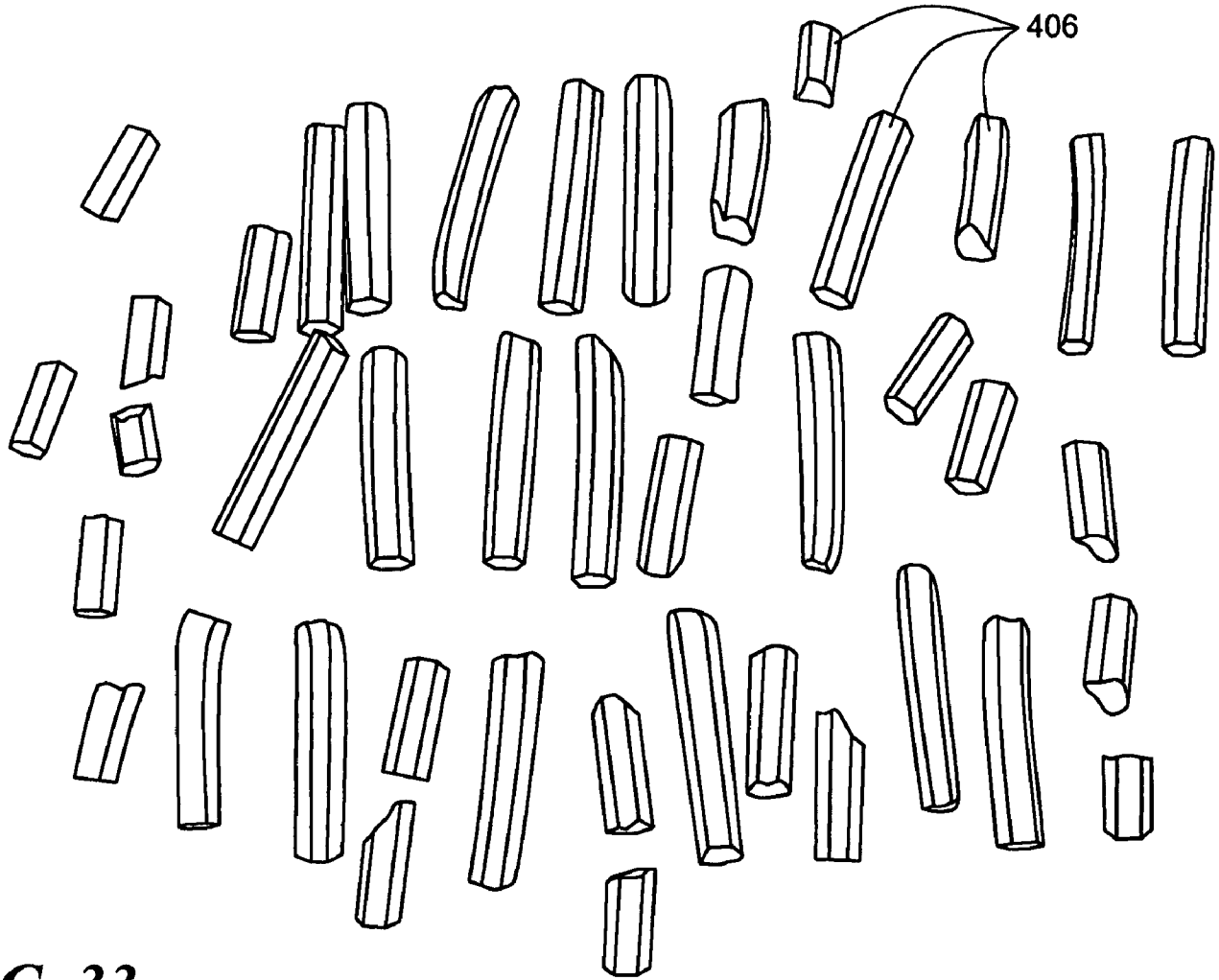
FIG. 33 is a schematic view showing a variety of individual penetrators rods after the test firing.

FIG. 31 shows the addition of detonators as shown at 450 just before test firing. There was one detonator per explosive charge section and all the detonators were fired simultaneously. FIG. 32-33 shows the results after test firing. The individual projectiles struck test surface 452 as shown in FIG. 32 and the condition of certain recovered projectiles is shown in FIG. 33.

Figure 34:
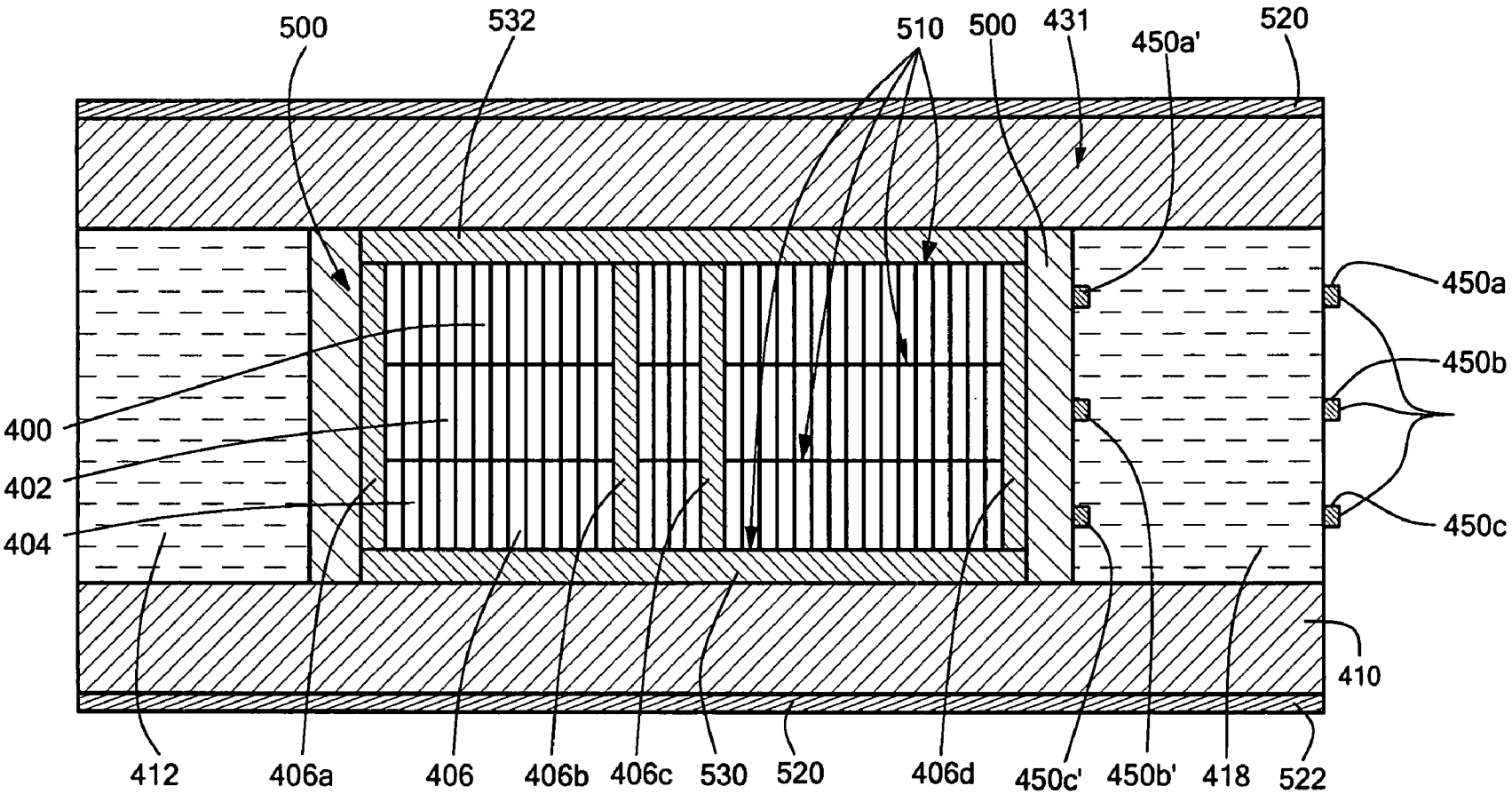
FIG. 34 is a schematic cross sectional view of a kinetic energy warhead with lower deployment angles in accordance with this invention.

To reduce the deployment angles of the projectiles when the detonators detonate the explosive charge sections thereby providing a tighter spray pattern useful for higher lethality in certain cases, several additional structures were added in the modified warhead of FIG. 34.

One means for reducing the deployment angles of projectiles 406 is the addition of buffer 500 between the explosive charge sections and the core. Buffer 500 is preferably a thin layer of poly foam ½ inch thick which also preferably extends beyond the core to plates 431 and 410. Buffer 500 reduces the edge effects of the explosive shock waves during deployment so that no individual rod experiences any edge effects.

Figure 35:
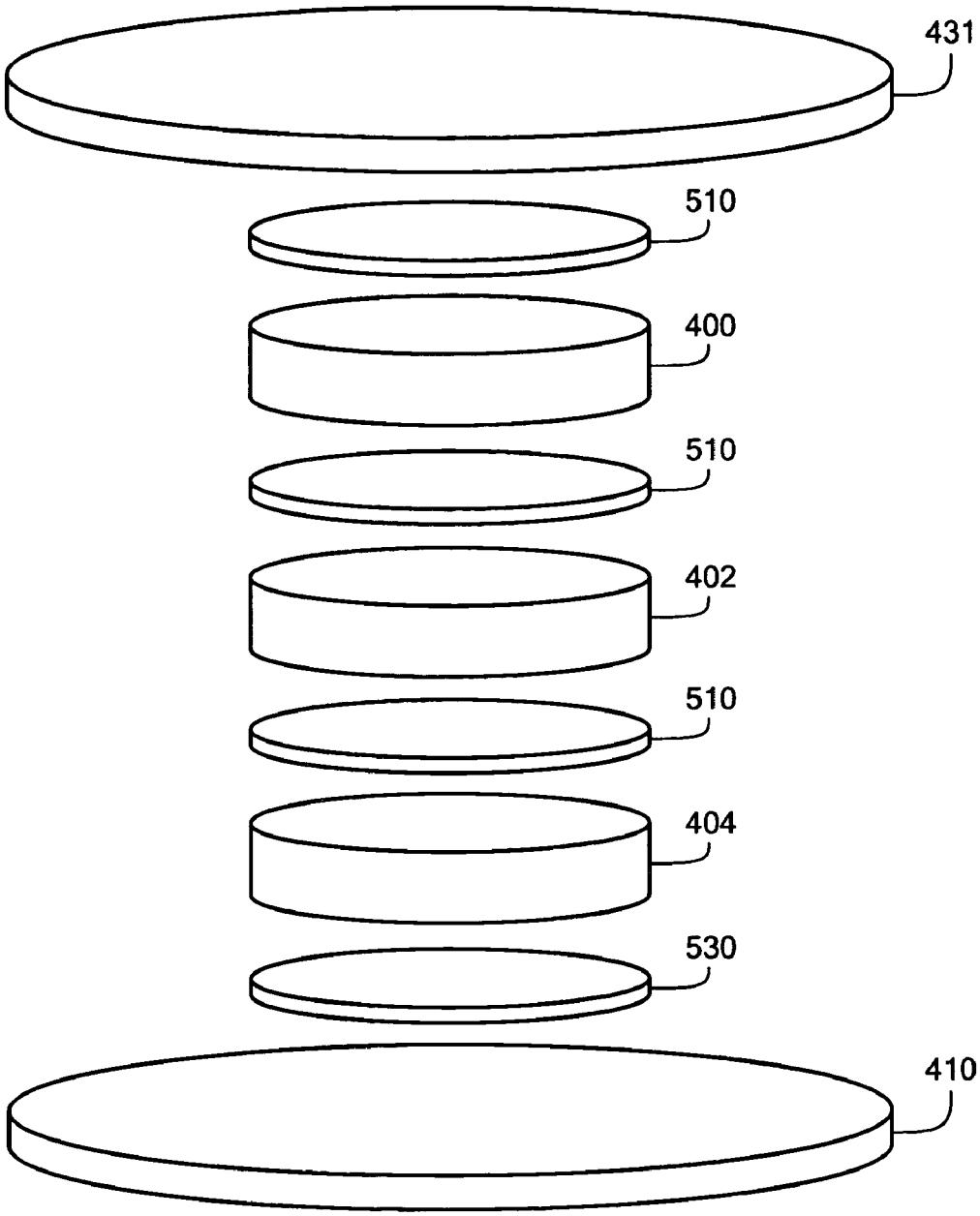
FIG. 35 is an exploded view showing the use of buffer disks between the individual bays of projectiles in order to lower the deployment angles of the rods in accordance with this invention.

Another means for reducing the deployment angles of the rods is the addition of poly foam buffer disks 510 also shown in FIG. 35. The disks are typically ⅛ inch thick and are placed between each end plate and the core and between each core bay as shown to reduce slap or shock interactions in the rod core.

Momentum traps 520 and 522 are preferably a thin layer of glass applied to the outer surface of each end plate 410 and 431. Also, thin aluminum absorbing layers 530 and 532 between each end plate and the core help to absorb edge effects and thus constitute a further means for tightening the spray pattern of the rods.

Figure 36:
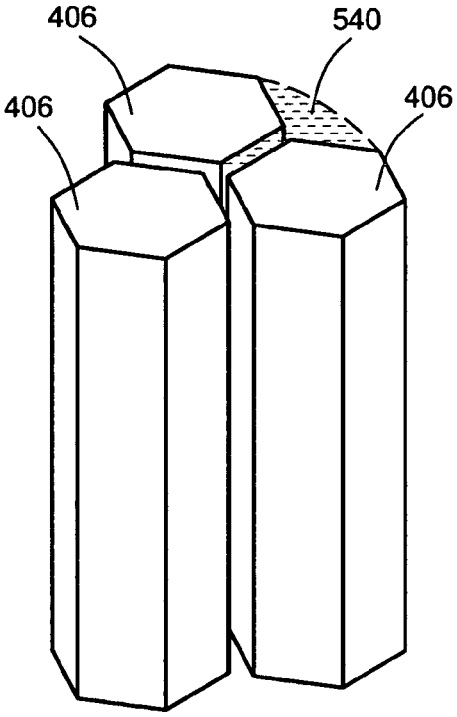
FIG. 36 is a schematic depiction showing the use of a glass filler around individual penetrators in order to lower the deployment angles in accordance with this invention.

In some examples, selected rods 406*a*, 406*b*, 406*c*, and 406*d* extend continuously through all the bays to help focus the remaining rods and to reduce the angle of deployment of all the rods. Another idea is to add an encapsulant 540, which fills the voids between the rods 406, FIG. 36. The encapsulant may be glass and/or grease coating each rod. Preferably, there are a plurality of spaced detonators 450*a*, 450*b*, and 450*c*, FIG. 34 for each explosive charge section each detonator typically aligned with a bay 400, 402, and 404, respectively, to provide a flatter explosive front and to further reduce the deployment angles of rods 406. Another initiation technique could be used to reduce edge effects by generating a softer push against the rods. This concept would utilize backward initiation where the multiple detonators 450*a*', 450*b*', and 450*c*' are moved from their traditional location on the outer explosive to the inner base proximate buffer 500. The explosive initiators are inserted at the explosive/foam interface which generates a flat shock wave traveling away from the rod core. This initiation logic generates a softer push against the rod core reducing all lateral edge effects.

Figure 37:
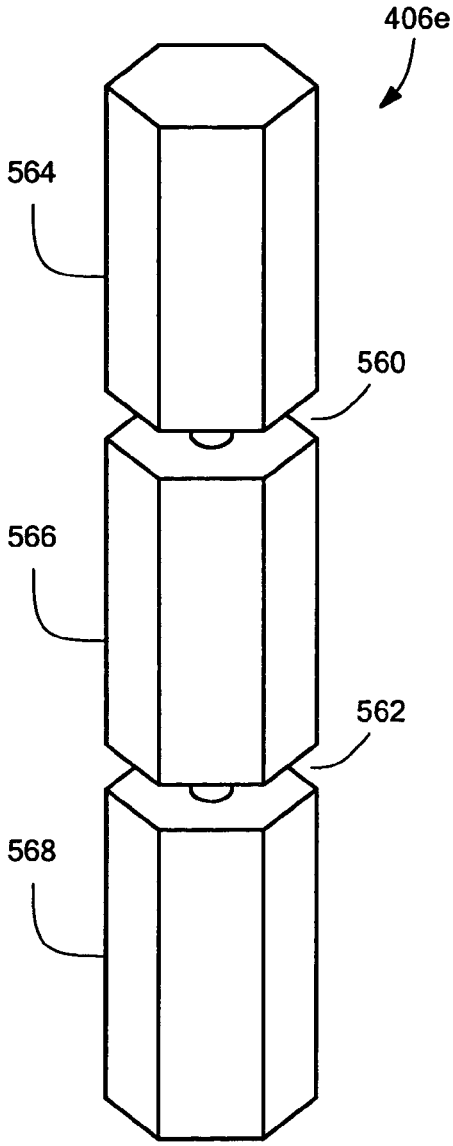
FIG. 37 is a schematic three-dimensional view showing a different type of projectile in accordance with this invention including two frangible portions.

Another idea is to use rod 406*e*, FIG. 37 at select locations or even for all the rods. Rod 406*e* extends through all the bays but includes frangible portions of reduced diameter 560 and 562 at the intersection of the bays, which break upon deployment dividing rod 406*e* into three separate portions 564, 566, and 568.

The result with all, a select few, or even just one of these exemplary structural means for reducing the deployment angles of the rods or projectiles when the detonator(s) detonate the explosive charge sections is a tighter, more focused rod spray pattern. Also, the means for aligning the projectiles discussed above with reference to FIGS. 6-11 and/or the means for aiming the projectiles discussed above with reference to FIGS. 12-15 may be incorporated with the warhead configuration shown in FIGS. 34-35 in accordance with this invention.

In one embodiment, the kinetic energy rod warhead of this invention includes a frangible skin that encases the projectiles, the core, the buffer, the explosive charge sections and the detonators. The frangible skin is designed such that it easily fractures and breaks when the explosive charge sections are detonated and therefore does not interfere with the deployment angles of the projectiles.

Figure 38:
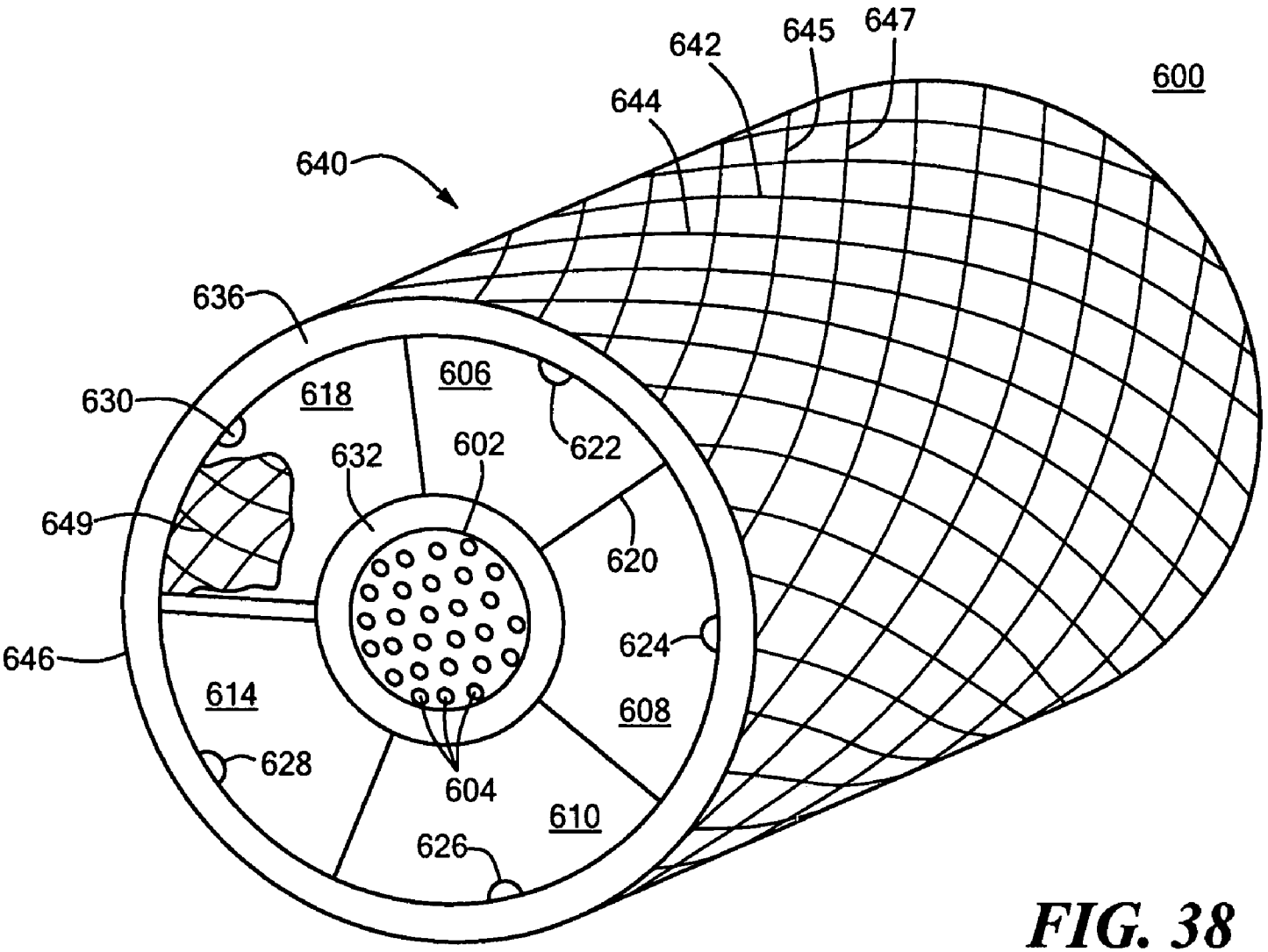
FIG. 38 is a schematic three-dimensional view of a kinetic energy rod warhead with a frangible skin in accordance with this invention.

Kinetic energy rod warhead 600, FIG. 38 includes projectile core 602 including a plurality of projectiles 604. Warhead 600 also includes an explosive charge divided into a number of sections 606, 608, 610, 614 and 618. Shields, such as shield 620, separate explosive charge sections 606 and 608. Warhead 600 also includes a plurality of detonators, such as detonator 622, 624, 626, 628 and 630. Selected detonators 622-630 (typically chip slapper type detonators) are used to initiate selected explosive charge sections 606-618 and deploy the plurality of projectiles 604 in core 602 with lower deployment angles as discussed above in reference to FIGS. 28-35. Warhead 600 may also include buffer 632, FIG. 38, similar in design to buffer 500, FIG. 34 described above, which is designed to reduce the deployment angles of projectiles 604, FIG. 38, when selected detonators 622-630 detonate selected explosive charge section 606-618. Frangible skin 636 encases explosive charge sections 606-618, detonators 622-630, buffer 632, core 602, and projectiles 604. Frangible skin 636 is designed to easily fracture and break apart (discussed in further detail below) when selected detonators 622-630 detonate selected explosive charge section 606-618. The result is that frangible skin 636 does not interfere with the deployment angles of the projectiles. At the same time, the frangible skin provides structural support for he warhead during handling, shipping, and deployment.

Figure 39:
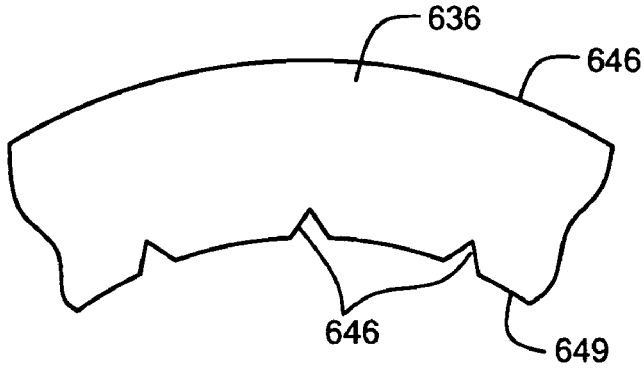
FIG. 39 is a schematic side view showing V-notched shaped grooves in the frangible skin shown in FIG. 38.
Figure 40:
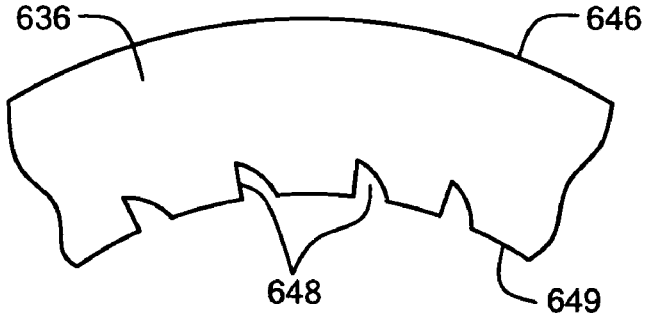
FIG. 40 is a schematic side view showing saw-toothed shaped grooves in the frangible skin shown in FIG. 38.
Figure 41:
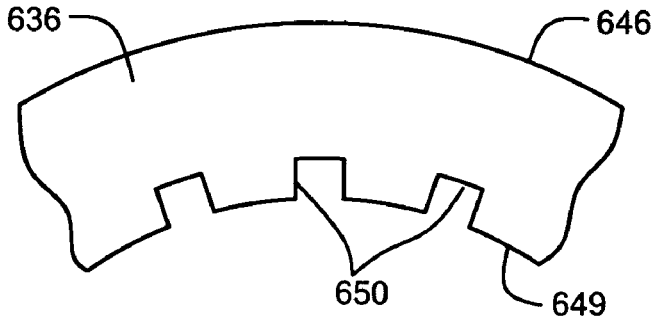
FIG. 41 is a schematic side view showing square-shaped grooves in the frangible skin shown in FIG. 38.
Figure 42:
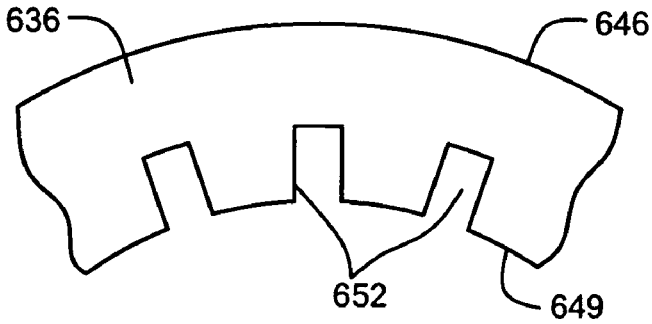
FIG. 42 is a schematic side view showing rectangular-shaped grooves in the frangible skin shown in FIG. 38.
Figure 43:
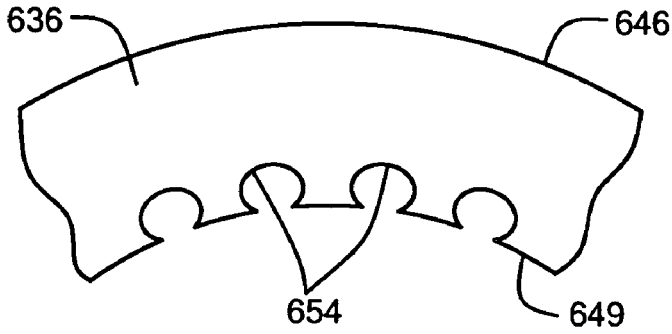
FIG. 43 is a schematic side view showing a circular-shaped grooves in the frangible skin shown in FIG. 38.
Figure 44:
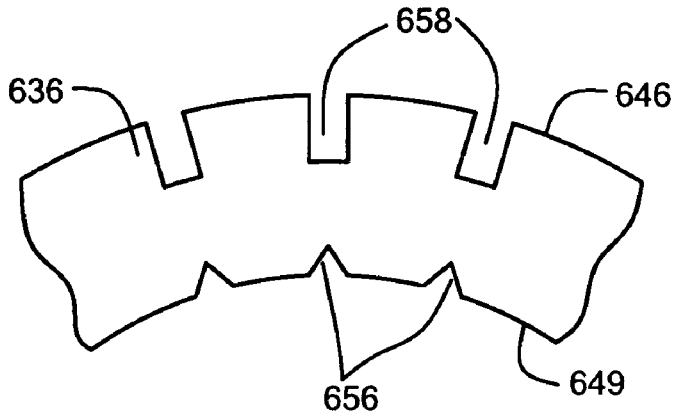
FIG. 44 is a schematic side view showing rectangular-shaped grooves in the outer surface of the skin shown in FIG. 38 and V-notched shaped grooves on the inner surface of the skin.

Frangible skin 636 is typically made of a ductile material, such as steel or aluminum, and is ideally about 0.15 inches thick. Skin 636 typically includes grid matrix 640 of grooves, e.g., spaced grooves 642, 644, 645, and 647 which may be formed on outer surface 646 of skin 636, inner surface 649, or disposed on a combination of outer surface 646 and inner surface 649 of skin 636. The grooves in skin 636 are designed so that skin 636 easily breaks and fractures into small fragments by the pattern defined by grid matrix 640 when selected detonators 622-630 detonate selected explosive charge sections 606-618. As shown in FIG. 39, skin 636 may include V-notched shaped grooves 646, saw-toothed shaped grooves 648, FIG. 40, square shaped grooves 650, FIG. 41, rectangular shaped grooves 652, FIG. 42, and circular shaped grooves 654, FIG. 43. Although as shown in FIGS. 39-43, the V-notched, saw-tooth, square, rectangular and/or circular shaped grooves are shown formed on inner surface 649 of skin 636, this is not a necessary limitation of this invention, as the V-notched, saw-tooth, square, rectangular and/or circular shaped grooves may be formed on outer surface 646 of skin 636 or formed on any combination of outer surface 646 and inner surface 649. Moreover, any shaped grooves as known to those skilled in the art may be utilized. For example, FIG. 44 shows a combination of V-notched shaped grooves 656 formed on inner surface 649 of skin 636 and rectangular shaped grooves 658 on outer surface 646. The textbook by the inventor hereof, R. Lloyd, "Conventional Warhead Systems and Physics and Engineering Design" cited supra provides additional details concerning skin designs used in blast fragmentation type warheads. Chapter 2 of that textbook proposes a type of controlled warhead fragmentation casing for a blast fragmentation type warheads.

Figure 45:
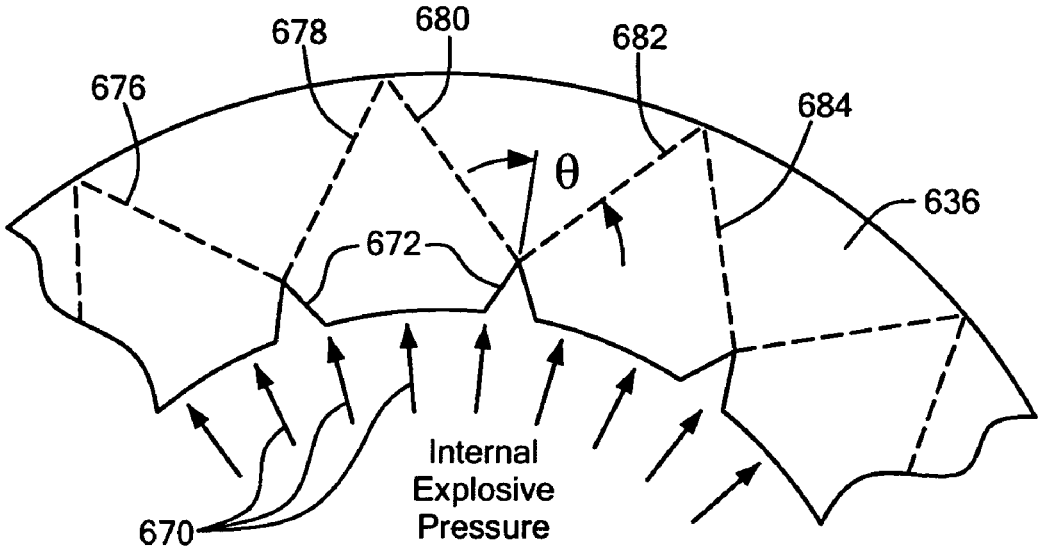
FIG. 45 is a schematic side view showing the fracture trajectory path of the V-notched shaped grooves shown in FIG. 39.

In operation, as described above, when selected detonators detonate selected explosive charge sections, explosive pressure is created, as shown by arrows 670, FIG. 45 which impacts the shaped grooves, e.g., V-shaped grooves 672, in skin 636. The explosive pressure on V-shaped grooves 672 creates shear trajectory paths, indicated at 676, 678, 680, 682 and 684, that causes skin 636 to quickly fracture and break into small fragments along the shear or fracture trajectory paths 676-682. The result is that the projectiles (discussed above) are deployed without any interference from skin 636 which maintains the lower deployment angles of the projectiles.

Figure 46C:
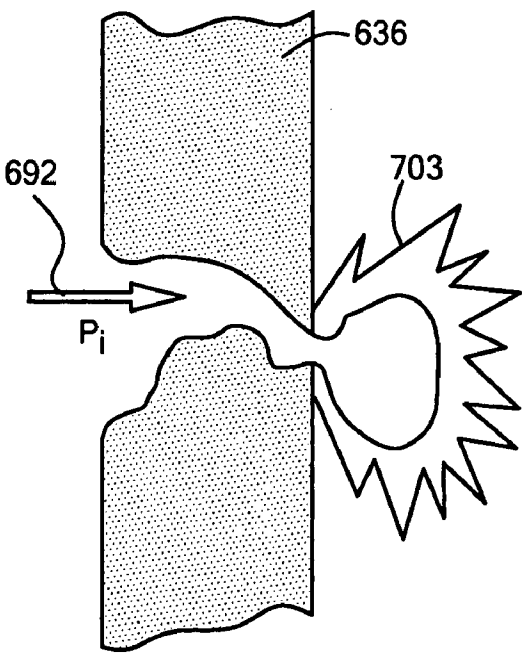
FIGS. 46A-46C are schematic side views showing an example of the fracture trajectory path of the saw tooth shaped groove shown in FIG. 40 and the resulting opening created in the skin after the explosive charge has been detonated.
Figure 46B:
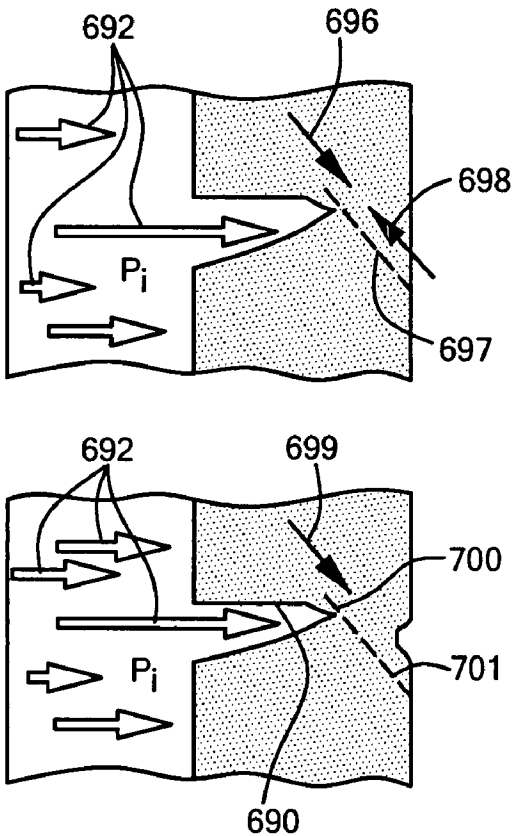
Figure 46A:
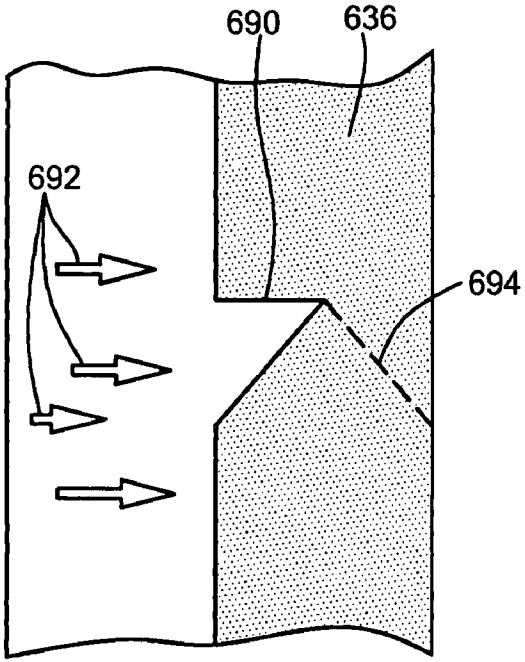

In another example, as shown in FIGS. 46A-46C, wherein skin 636, FIG. 46A includes saw-tooth shaped groove 690, the high explosive pressure, indicated by arrows 692 created from the explosive charge sections creates a shear fracture as shown by shear plane 694. As shown in FIG. 46B, the resulting shear fracture may be traveling in two directions, indicated by arrows 696 and 698 along plane 697. The fracture may also propagate outward from tip 700 of groove 690 in the direction indicated by arrow 699 that creates incremental crack 701. In either case, explosive pressure 692 causes the explosive gas products to vent through the shear fracture to fracture and break skin 636, as indicated at 703, FIG. 46C.

Figure 47A:
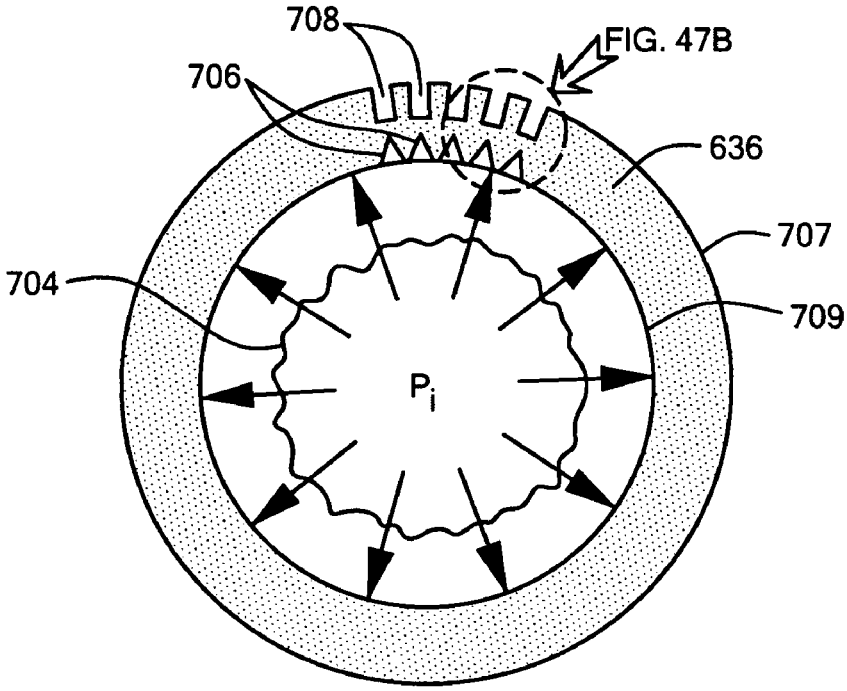
FIGS. 47A and 47B are schematic side views showing an example of a fracture trajectory path the skin shown in FIG. 44.
Figure 47B:
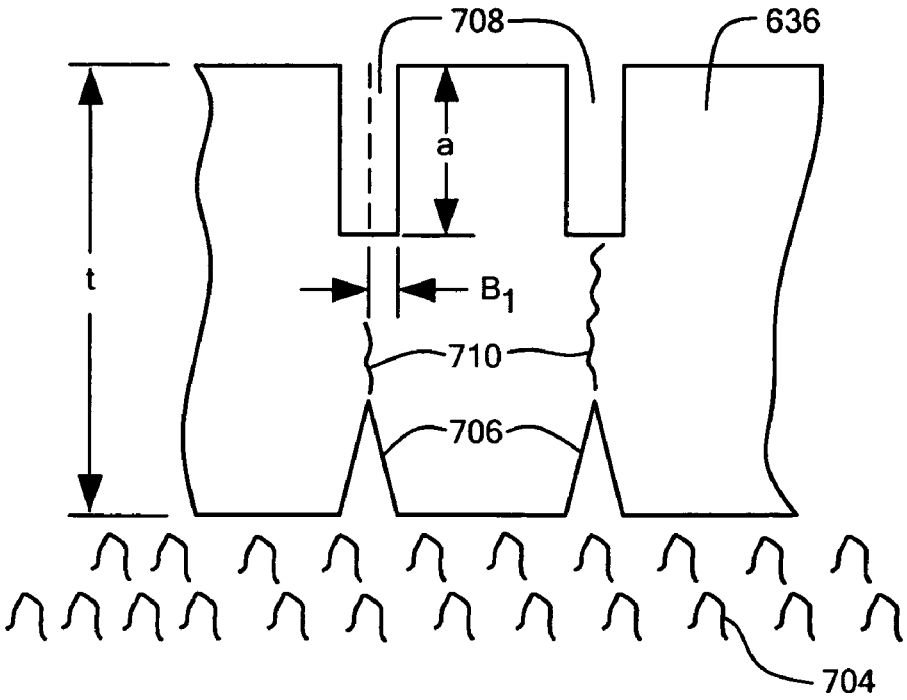

In another example, wherein skin 636, FIG. 47A includes V-notched shaped grooves 706 on inner surface 709 and rectangular shaped grooves 708 on outer surface 707, explosive pressure 704 creates a primary fracture trajectory paths 710, FIG. 47B in skin 636. In this example, V-notch shaped grooves 706 are directly aligned with rectangular shaped grooves 708. Similar as described above, fracture trajectory paths 710 provide skin 636 with the ability to quickly and easily fracture and break into small fragments such that skin 636 does not interfere with the deployment angles of the projectiles.

Figure 48:
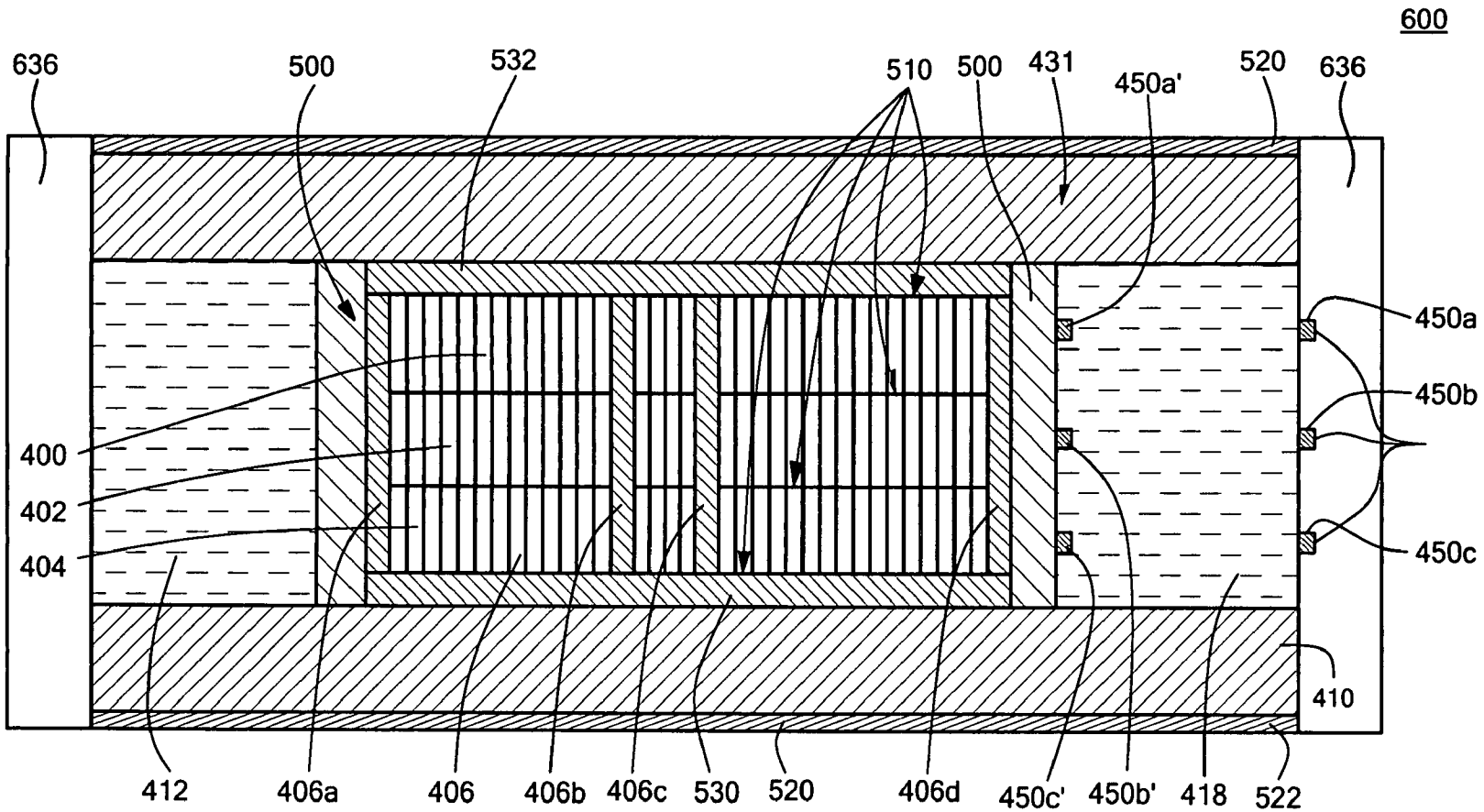
FIG. 48 is a schematic cross sectional view of the kinetic energy rod warhead with lower deployment angles and the frangible skin in accordance with this invention.

FIG. 48, where like parts have been given like numbers, shows an example of kinetic energy rod warhead described above in reference to FIG. 34 employing frangible skin 636.

In one embodiment, the kinetic energy rod warhead of this invention includes a plurality of different size projectiles which are effective against ballistic missiles having submunition or bomblet payloads. The different size projectiles typically include a large number of small projectiles which are effective against destroying submunition payloads and a small number of larger, typically heavier projectiles which are effective against destroying bomblet payloads.

Figure 49:
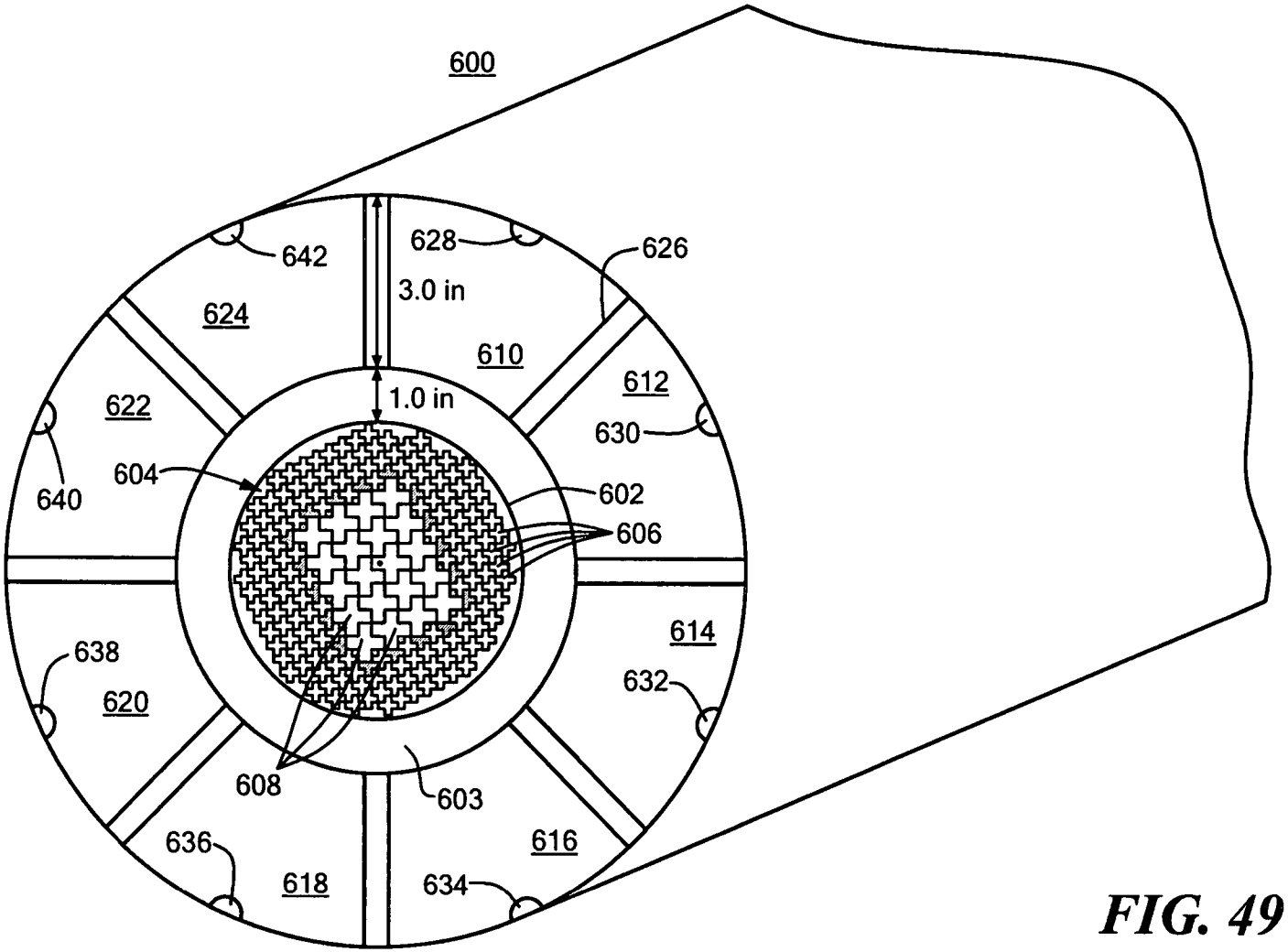
FIG. 49 is a schematic three-dimensional view of a kinetic energy rod warhead employing a plurality of different sized projectiles in accordance with this invention.

For example, kinetic energy rod warhead 600, FIG. 49, includes projectile core 602 including plurality 604 of different size projectiles. The projectiles ideally include a larger number of small projectiles 606 and a smaller number of large projectiles 608. The large projectiles are typically heavier than the small projectiles, typically weighing about 113.7 g compared to about 28.6 g for the small projectiles. Warhead 600 also includes an explosive charge divided into a number of sections 610, 612, 614, 616, 618, 620, 622 and 624. Shields, such as shield 626, separate explosive charge sections 610 and 612. Warhead 600 also includes a plurality of detonators, such as detonators 628, 630, 632, 634, 636, 638, 640 and 642. Selected detonators 628-640 (typically chip slapper-type detonators) are used to initiate selected explosive charge sections 610-624 and deploy the plurality of different size projectiles. Foam body 603, similar to foam body 140, FIG. 9, as discussed above, may be employed to surround core 602, FIG. 49, for improved projectile alignment. The smaller projectiles 606 are effective at destroying ballistic missiles having submunition payload and the larger, heavier projectiles 608 are effective at destroying bomblet payloads. The result is that kinetic energy rod warhead 600 of this invention effectively destroys ballistic missiles having either submunition or bomblet payloads, as discussed in further detail below.

Figure 50:
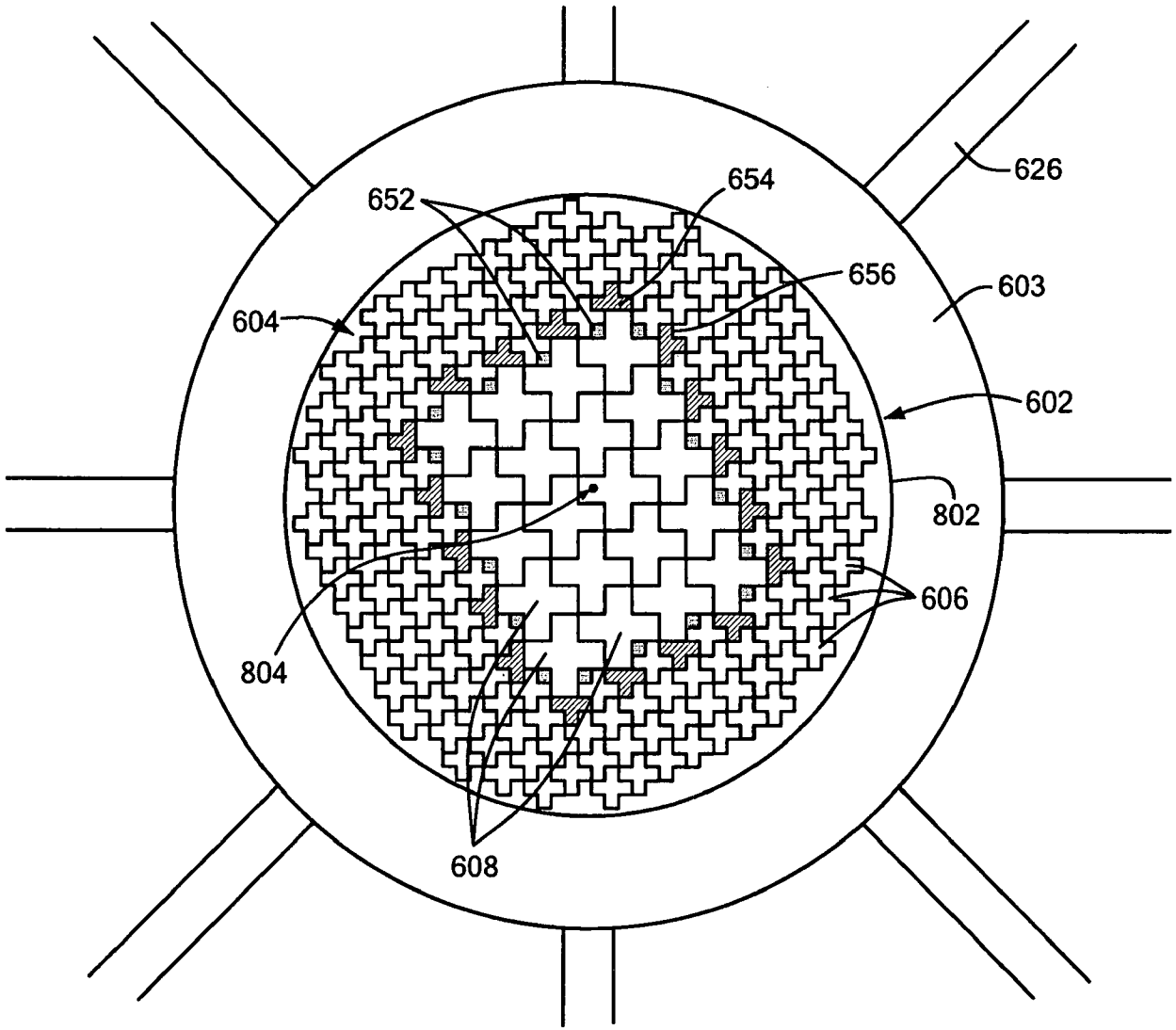
FIG. 50 is a schematic cross-sectional view showing in further detail one example of the different sized projectiles shown in FIG. 49.

FIG. 50, where like parts have been given like numbers, shows an enlarged view of projectile core 602 including smaller projectiles 606 and larger projectiles 608. In this example, all the projectiles have a cruciform cross section. The projectiles may also include cube shaped projectiles, such as cube shaped projectiles 652 and tetris shaped projectiles, such as tetris shaped projectiles 654.

Typically, smaller projectiles 606 are located proximate outer region 802 of core 602 while the larger projectiles 608 are located proximate the center region 804 of core 602.

In one design, the projectiles include about 70% smaller projectiles 606 and about 30% larger projectiles 608. The mass of each of the large projectiles 608 is typically greater than the mass of each of the small projectiles 606. In one example, the mass of each small projectiles 606 in core 602 is about 28 grams and the mass of each of the large projectiles 608 is about 114 grams. The plurality of different size projectiles may be made of tungsten or similar materials.

Figure 51:
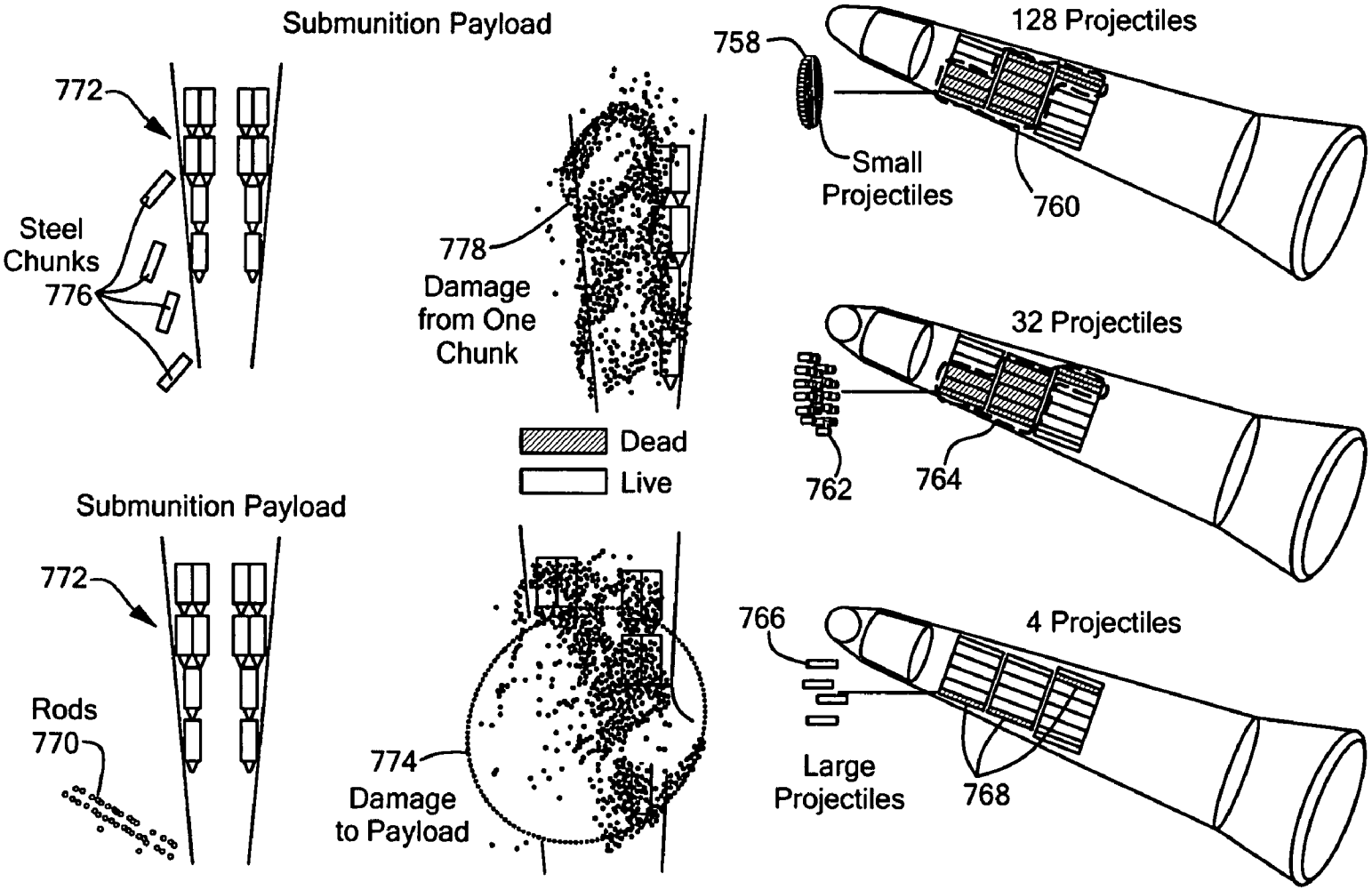
FIG. 51 is a schematic three-dimensional view showing that a large number of small projectiles is more effective against a ballistic missile with a submunition payload.

A simulation showing that a larger number of smaller projectiles is more effective against a ballistic missile having a submunition payload is shown in FIG. 51. In this example, the smaller projectiles, e.g., 128 projectiles, indicated at 758, are effective at destroying submunition payloads, as shown by the destroyed submunitions indicated at 760. In contrast, when a fewer number of projectiles were deployed, e.g., 32 projectiles, as indicated at 762, fewer submunitions were destroyed, as shown by the destroyed submunitions indicated at 764. When four large projectiles were deployed, as indicated at 766, only three submunitions were destroyed, as indicated at 768. A large number of smaller projectiles or rods is also shown at 770 impacting submunition payload 772. As shown at 774, the large number of small projectiles or rods created substantial damage to the submunition payload 772. In contrast, when a small number of large projectiles indicated at 776 were deployed against submunition payload 772, only minimal damage resulted to submunition payload 772, as indicated at 778.

Figure 52:
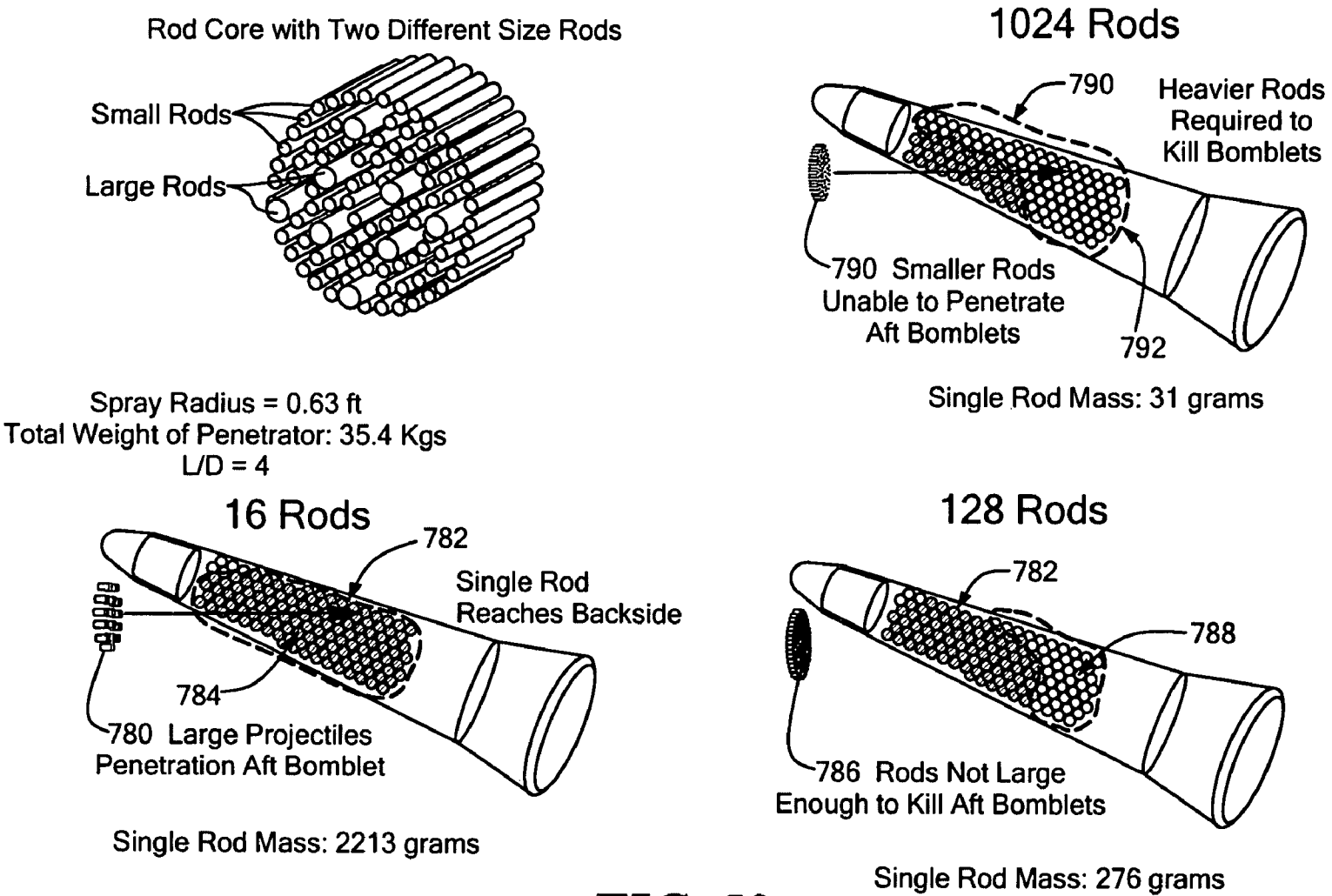
FIG. 52 is a schematic three-dimensional view showing that a small number of larger projectiles is more effective against a ballistic missile with a bomblet payload.

FIG. 52 is a simulation showing that a few larger, heavier projectiles are very effective against ballistic missiles having bomblet payloads. In this example, when a small number of larger projectiles, e.g., four heavier projectiles or rods each weighing about 2273 grams, as indicated at 780 are deployed the large projectiles penetrated bomblet payload 782 and destroyed almost all the bomblets therein, as indicated by destroyed bomblets 784. However, when a larger number of rods were used, e.g., 128 rods each weighing about 276 grams, as indicated at 784, the larger number of smaller projectiles or rods did not destroy the aft bomblets, as indicated by live bomblets 788. When an even larger number of smaller projectiles or rods where deployed, e.g., 1024 rods each weighing about 31 grams, as indicated at 790 a substantial portion of the aft bomblets were not destroyed, as shown by the live bomblets 792. Hence, a small number of larger and heavier penetrators are more effective at destroying ballistic missiles having bomblet payloads.

Because kinetic energy rod warhead 600, FIG. 49 of this invention deploys both a large number of small projectiles and a small number of larger and heavier projectiles or rods at the same time, warhead 600 effectively destroys ballistic missiles having submunition and/or bomblet payloads.

Figure 53C:
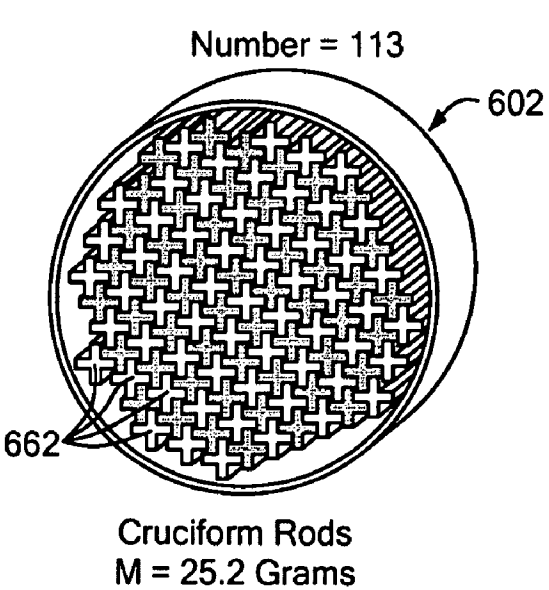
FIGS. 53A-53C are schematic side views showing the packing density of cruciform shaped projectiles and cylindrical rods in accordance with this invention.
Figure 53B:
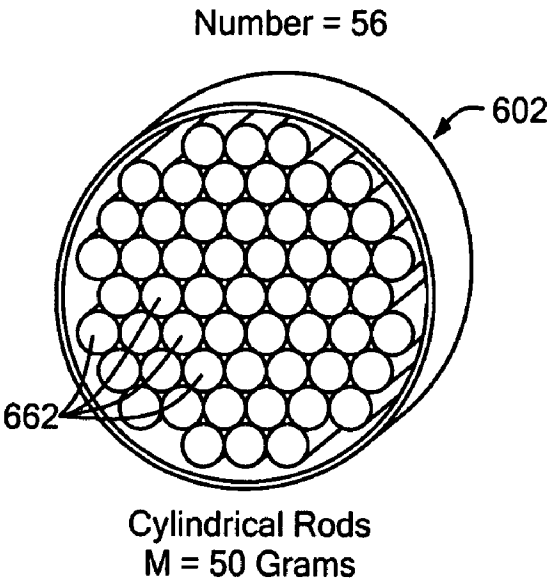
Figure 53A:
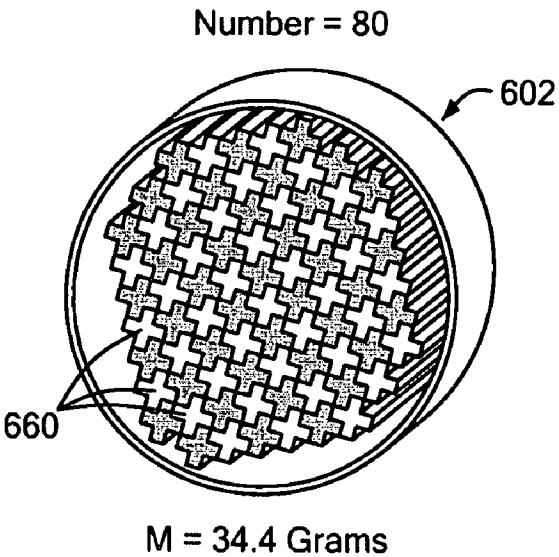

As discussed above, the different size rods ideally have a cruciform cross section. The cruciform shaped rods provide for tight packing of the projectiles within core 602 with minimal air space therebetween. Tight packing of the cruciform cross-sectional shaped projectiles provides for a larger number of projectiles to be packed within core 602 than cylindrical shaped rods. For example, as shown in FIG. 53A the packing density of the cruciform shaped rods 660 allows about 80 projectiles to be packed projectile core 602. In contrast, cylindrical shaped rods 662 FIG. 53B allows only about 56 rods or projectiles to be packed in core 602. The cruciform shaped rods can be even more tightly packed, as shown in FIG. 53C, where, in this example, 113 cruciform projectiles 662 were packed within the core 602. The higher number of projectiles that can be packed within core 602 provide a higher spray pattern density on the enemy target. In this example, the larger cruciform shaped rods 660 have a diameter of about 0.75 inches and each weigh about 34.4 grams and cruciform shaped rods 662 have a diameter of about 0.375 inches and each weigh about 25.2 grams. Moreover, the use of cruciform projectiles or penetrators are effective against bulk or liquid filled tanks because they enhance the transfer of kinetic energy causing hydraulic ram effects. This process is caused by high shock pressure with projectile drag causing sub-explosive forces on the tank wall.

Figure 54A:
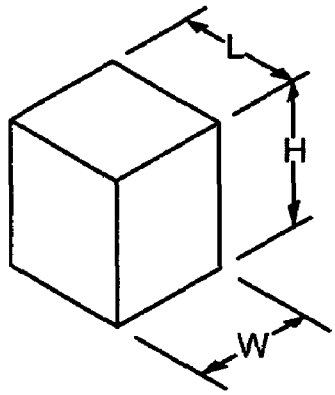
FIG. 54A is a schematic three-dimensional view of a cube shaped projectile in accordance with this invention.
Figure 54B:
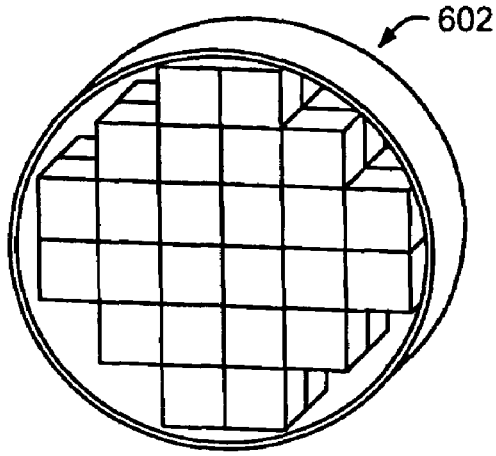
FIG. 54B is a schematic side view showing the packing density of the cube shaped projectile shown in FIG. 54A.
Figure 55A:
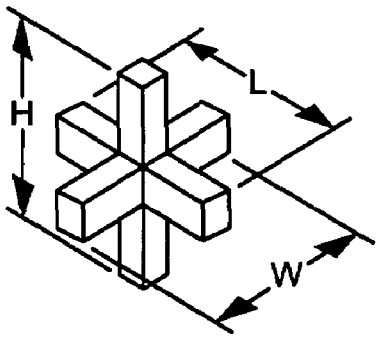
FIG. 55A is a three-dimensional view showing the tetris shaped projectile in accordance with this invention.
Figure 55B:
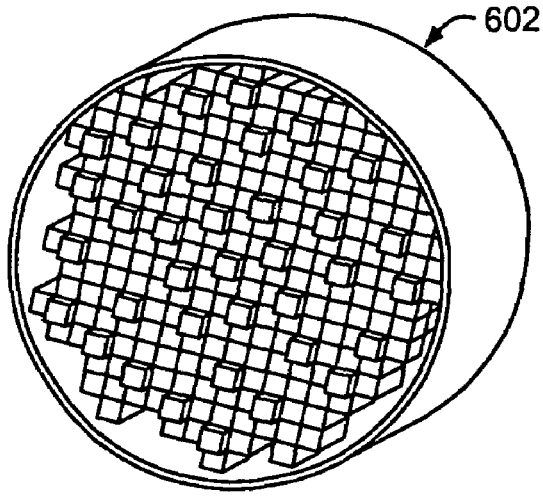
FIG. 55B is a schematic cross-sectional view showing the packing density of the tetris shaped projectile shown in FIG. 55A.

As discussed above, the preferred projectiles do not have a cylindrical cross-section and instead have cruciform cross-section. Also, the projectiles may have a pointed nose or at least a non-flat nose such as a wedge-shaped nose. Projectile 240, FIG. 17 has a pointed nose while projectile 242, FIG. 18 has a star-shaped nose. Other projectile shapes are shown at 244, FIG. 19 (a star-shaped pointed nose); projectile 246, FIG. 20; projectile 248, FIG. 21; and projectile 250, FIG. 22. Projectiles 252, FIG. 23 have a star-shaped cross section, pointed noses, and flat distal ends. The increased packaging efficiency of these specially shaped projectiles is shown in FIG. 24 where sixteen star-shaped projectiles can be packaged in the same space previously occupied by nine penetrators or projectiles with a cylindrical shape. The projectiles or rods may also be cube shaped, as shown in FIG. 54A. The cube shape also provides for a tightly packed density, as shown in FIG. 54B. Typically each cube has a mass of about 50 grams and about 48 cubes may be packed in core 602. The plurality of projectiles may have a three-dimensional tetris shape as shown in FIG. 55A. The tetris shaped rods also provide for a tightly packed density in core 602, as shown in FIG. 55B.

The overall deployment angle of the rods of a kinetic energy rod warhead is fairly important: smaller deployment angles generating higher overall spray densities for increased lethality. To contain the rods, typically end plates 410 and 431, FIGS. 30-31 are used to contain both ends of the warhead to reduce edge effects which cause large spray angles and lower lethality. While the end plates may be made of aluminum, steel is often used for maximum containment. Also, momentum traps 520, 522, FIG. 34, which may each be a thin layer of glass, may be applied to the outer surface of end plates 410, 431 as a further means for tightening the spray pattern of the rods. Such end plates may not be ideally suitable for all uses, however. For example, when utilized in space borne applications, there are upper limits to the thickness and weight of such end plates. Such increased thickness and weight adds parasitic weight or mass which can increase costs.

In one preferred embodiment, the kinetic energy rod warhead of this invention includes explosive sheets or disks as or as part of the endplates to reduce edge effects and reduce the deployment angle of the rods. The explosive endplates provide an explosive force that acts on each end of the warhead core. The explosive force from the explosive endplates acts as a thick endplate which helps confine spray angles in the vertical direction. The explosive end plates are designed to give the rods an inward force causing a higher density spray pattern without the weight of traditional end plates.

Figure 56:
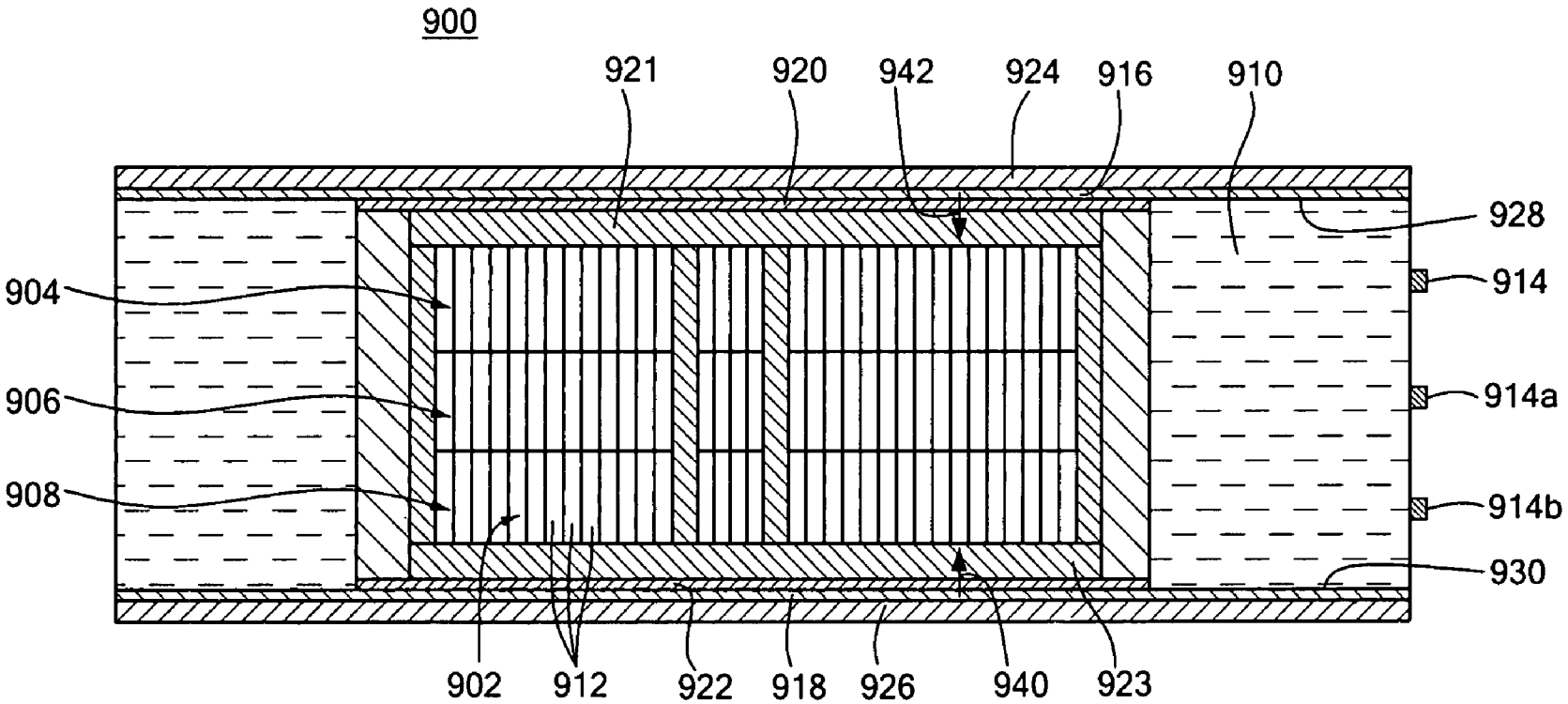
FIG. 56 is a schematic cross-sectional view of a kinetic energy rod warhead with explosive end plate confinement in accordance with this invention.

Kinetic energy rod warhead 900 in accordance with this invention, FIG. 56, includes projectile core 902, which may include projectile bays 904, 906, and 908. Explosive charge 910, which may be divided into a number of sections, see, e.g. FIGS. 12 and 13, is about core 902, FIG. 56. Projectile core 902 includes a plurality of individual projectiles or rods 912, and further includes at least one detonator 914 for detonating explosive charge 910, but may include multiple detonators 914, 914*a*, 914*b*.

Explosive sheets or end plates 916, 918, which may be in the form of explosive disks, are on each end of projectile core 902. Typically, explosive sheets 916 and 918 will be made of PBXN-109, or any other suitable material, as known to those of ordinary skill in the art.

In one example, warhead 900 includes buffer 920 between explosive sheet 916 and core 902, and buffer 922 between explosive sheet 918 and core 902. Buffers 920 and 922 may be made of foam, or other suitable material, to assist in the prevention of breakage of projectiles 912. There may be thin aluminum absorbing layers 921 and 923 between buffers 920, 922 respectively, and projectile core 902 to further tighten the spray pattern of rods 912. In one embodiment, warhead 900 includes thin plate 924 disposed on the outer surface of explosive sheet 916 and thin plate 926 disposed on the outer surface of explosive sheet 918. Thin outer plates 924 and 926 are typically made of aluminum and act as a tamper against the explosive charge section. Explosive sheets 916 and 918 are attached to or adjacent explosive charge 910, as shown specifically at 928 and 930. Thus, for example, when detonator 914 detonates explosive charge 910, this also detonates explosive sheets 916 and 918.

Figure 57:
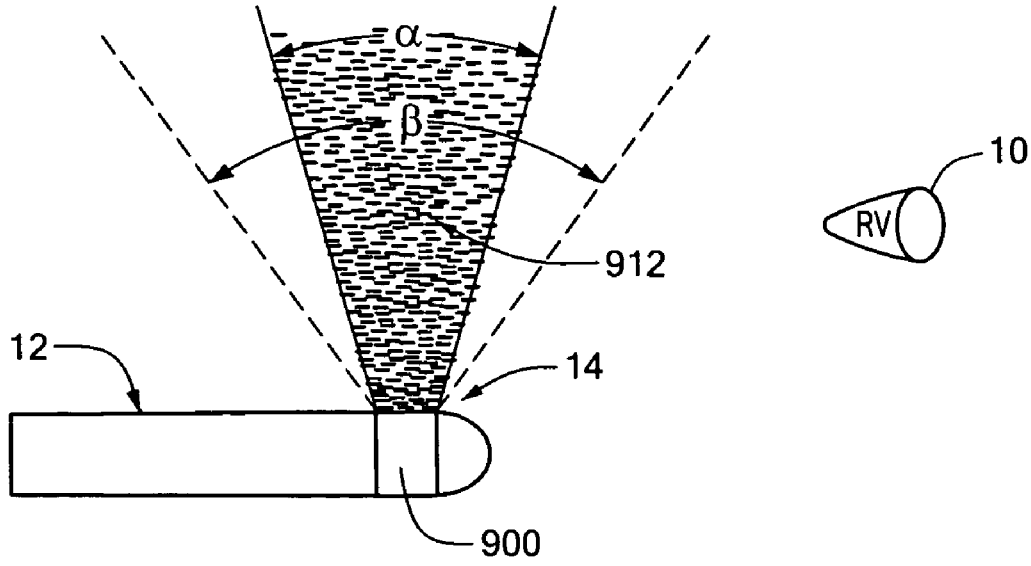
FIG. 57 is a schematic side view showing deployment of a kinetic energy rod warhead incorporated with explosive end plates in accordance with this invention.
Figure 58:
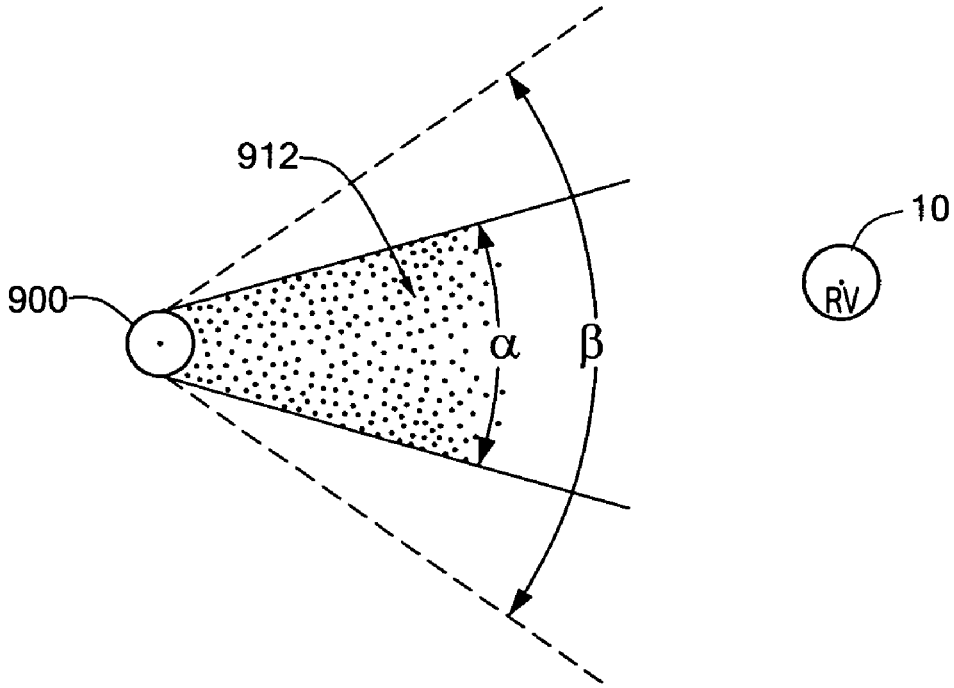
FIG. 58 is a schematic cross-sectional view showing deployment of a kinetic energy rod warhead incorporated with explosive end plates in accordance with this invention.

Each explosive end plate or sheet 916 and 918 is structured and arranged to contain the ends of the projectile core when deployed to decrease the deployment angle of the individual rods or projectiles 912. When detonated, explosive end plates 916, 918 provide a force that acts on projectile core 902 and projectiles 912 are given an inward force in the direction of arrows 940 and 942. The momentum of projectiles 912 is altered from explosive 910, and thus both the physical and temporal spacing of projectiles 912 is decreased, the latter evidenced by the projectiles striking the target at closer time intervals. This more highly dense spray pattern is shown in FIGS. 57 and 58. Deployment angle a achieved with the explosive end plates of this invention is much lower than deployment angle β without end plates, and it is achieved with the much lighter explosive end plates rather than traditional heavy metal end plates. The thickness of each explosive sheet 916, 918 is typically at least one order of magnitude thinner than the steel end plate traditionally used to contain the rods and decrease the deployment angle. Kinetic energy rod warhead 900 of this invention is shown with missile 12 and as part of kill vehicle 14, although this is not a necessary limitation of the invention. Projectiles 912 with lower deployment angle a are directed toward re-entry vehicle 10 as shown.

Also, depending on the particular desired application, other means to reduce the overall deployment angle of the rods may be utilized in conjunction with the explosive end plates of the subject invention. Such means include but are not limited to: buffer 500, FIG. 34, which may be a thin layer of poly foam, between explosive charge sections 412, 418 and the projectile core, e.g. projectile core 602, FIG. 38; polyfoam buffer disks 510, FIGS. 34 and 35 between each end plate 410, 431 and the core, and between each core bay 400, 402 and 404; encapsulant 540, FIG. 36 between the rods; and a plurality of spaced detonators 450*a*, 450*b*, 450*c*, FIG. 34 or backward initiation with a plurality of spaced detonators 450*a*', 450*b*', 450*c*'. Also, the explosive end plates of the present invention may be utilized with any form of kinetic energy rod warhead including those described herein.

Thus, the present invention reduces the overall deployment angle of the rods for higher lethality with lighter weight and less parasitic mass.

Figure 59:
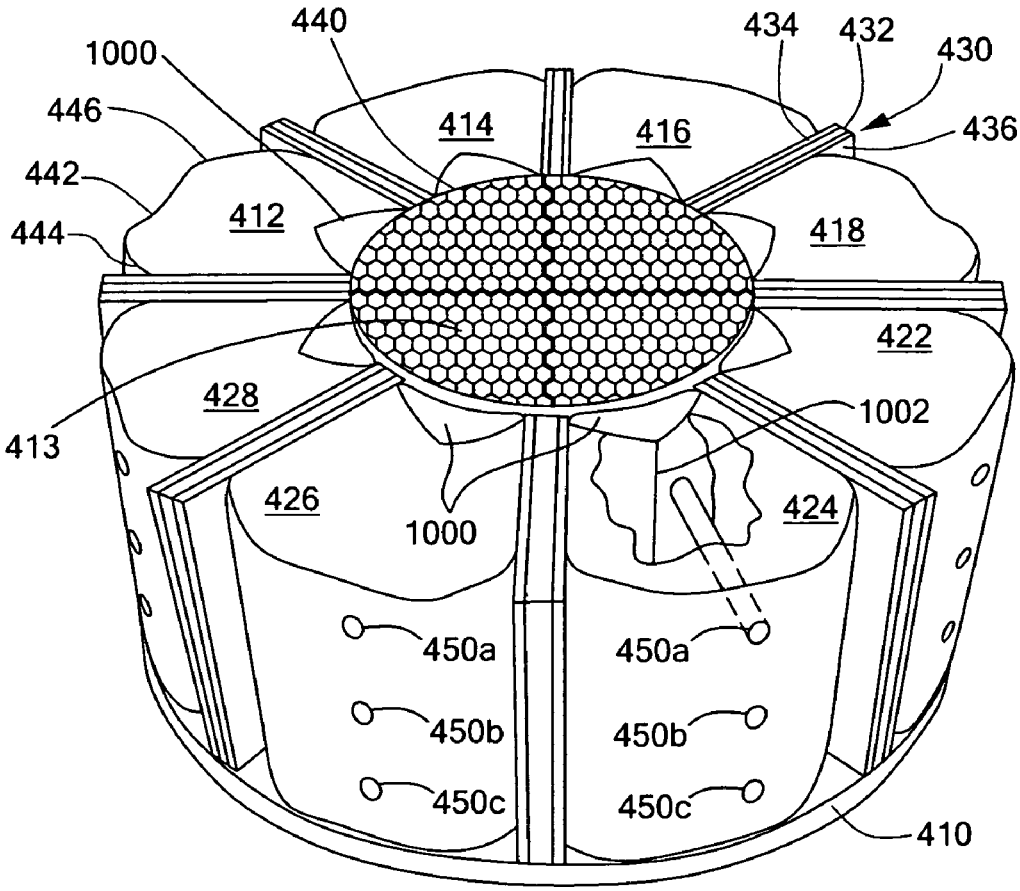
FIG. 59 is a schematic three-dimensional view of an example of a warhead in accordance with the subject invention incorporating wave shapers to increase the density of the spray pattern and to increase the lethality of the warhead.

Also, wave shapers in the explosive charge may be utilized to further increase the spray pattern density of the projectiles. In FIG. 59, expendable wave shapers 1000 are disposed between each explosive charge section and core 413 to increase the lethality of the warhead by increasing the density of the spray pattern of the individual projectiles or rods of core 413. Typically, there is one wave shaper for each explosive charge section as shown. The apex 1002 of wave shaper 1000 is typically positioned adjacent detonators 450*a*, 450*b*, and 450*c*.

Figure 60:
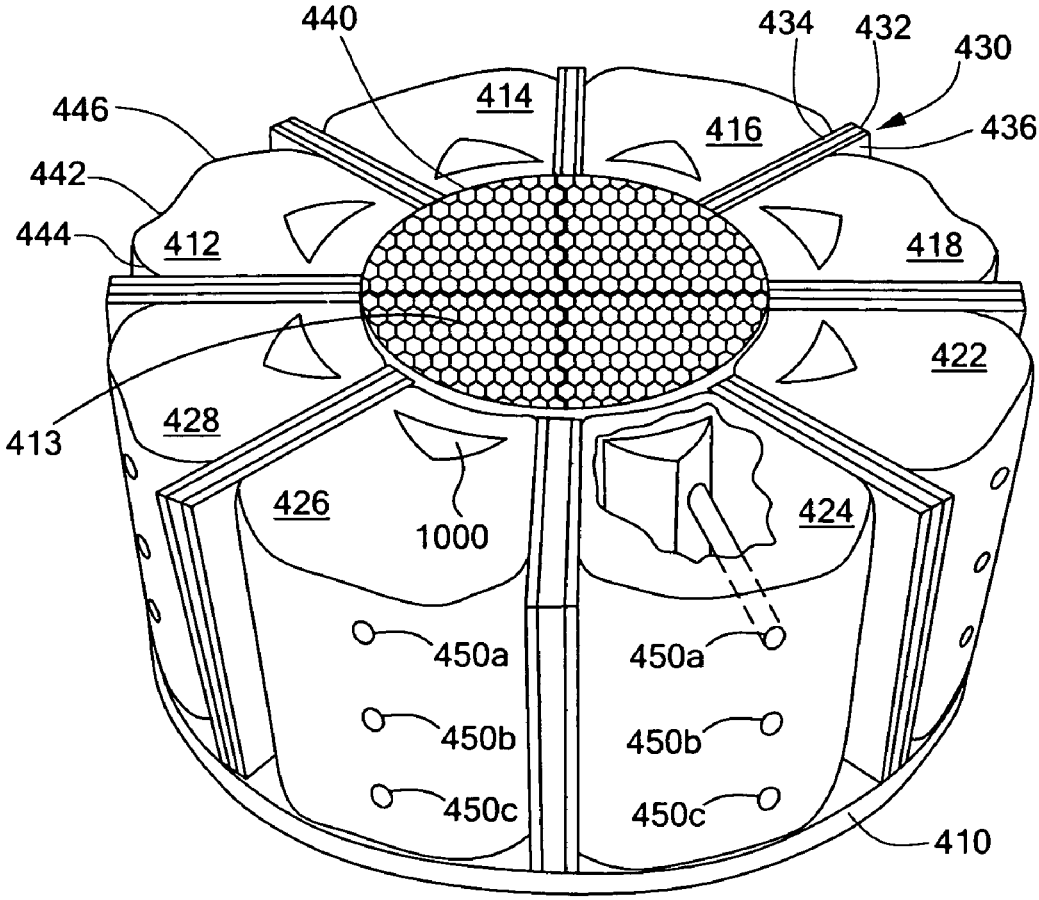
FIG. 60 is a schematic three-dimensional view of one embodiment of another warhead in accordance with the subject invention incorporating wave shapers to increase the density of the spray pattern and to increase the lethality of the warhead.

In FIG. 60, a wave shaper 1000 is disposed in each explosive charge section. In this way, a buffer layer as shown at 500 in FIG. 34 can be disposed between each explosive charge section and the rod core to further reduce the deployment angles of the projectiles as discussed above.

Figure 61:
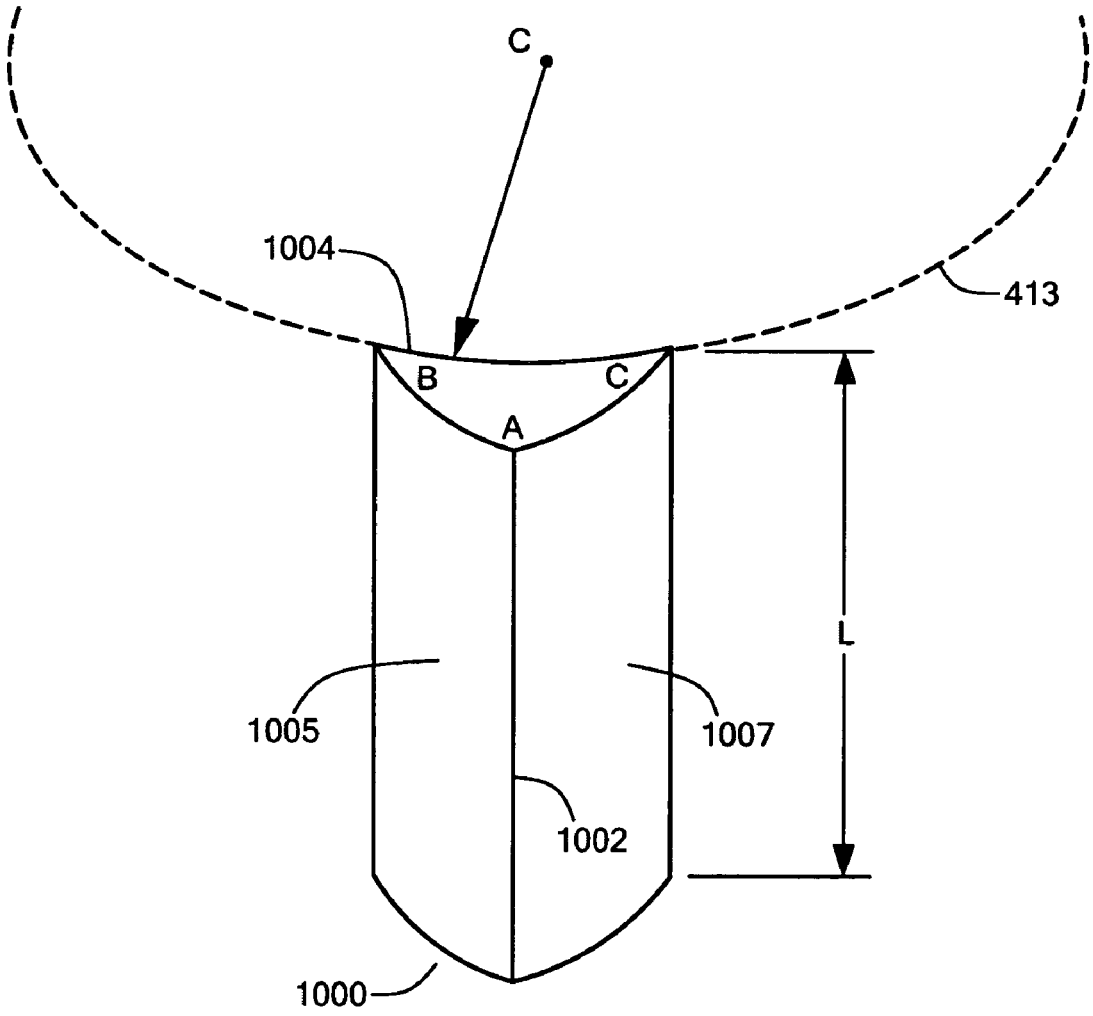
FIG. 61 is a schematic view of an example of a wave shaper to be incorporated into the warheads of FIGS. 59 and 60.

A typical wave shaper 1000, FIG. 61 is triangular in shape with an apex 1002 defined by obtuse angle A. Base 1004 is curved to match the profile of the projectile core 413. The core 413 has a center C and the curvature of base 1004 defines an arc angle from the center C of core 413 as shown. The wave shaper 1000 has a length L which extends the length of each explosive charge section. In one example, angle A was approximately 150°, and angles B and C were each 15°. L was 6 inches and curved base 1004 was approximately 2-3 inches in length while curved sides 1005 and 1007 were between 1-2 inches in length.

The use of wave shaper technology in conjunction with the kinetic energy rod warhead designs of the subject invention enables the warheads to deploy the rods at a lower overall spray angle in the horizontal direction. Examples of materials for the wave shaper include Lucite plastic, wood, or soft metallic material with a low density. The wave shaper directs the shock wave of the explosive charges to travel along the outer surfaces 1005 and 1007, FIG. 61 to provide a more uniform inward impulse on the rod core 413, FIGS. 59-60. Upon initiation of detonators 450*a*, 450*b*, and 450*c*, the shock wave travels along the sides 1005 and 1007, FIG. 61 of wave shaper 1000 creating a uniform inward push to rod core 413. This provides an inward overall force causing a significant decrease in the overall spray pattern of the individual rods of core 413. In this way, the spray pattern can be tailored to achieve small spray angles which generate high lethality against ballistic missile targets.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

Other embodiments will occur to those skilled in the art and are within the following claims:

What is claimed is:

1. A kinetic energy rod warhead comprising:

a projectile core including a plurality of individual projectiles;

an explosive charge about the core;

at least one detonator for the explosive charge;

an explosive sheet on each end of the projectile core to reduce deployment angles of the projectiles;

a buffer between each explosive sheet and the projectile core;

an aluminum absorbing layer between each buffer and the projectile core; and an outer plate disposed on each outer surface of the explosive sheets.

2. The warhead of claim 1 in which each explosive sheet is made of PBXN-109.

3. The warhead of claim 1 in which each explosive sheet is adjacent the explosive charge.

4. The warhead of claim 1 in which each explosive sheet is attached to the explosive charge.

5. The warhead of claim 1 in which each explosive sheet is structured and arranged to contain the ends of the projectile core when deployed to decrease the deployment angle of the individual projectiles.

* * * * *